US010008804B2

(12) United States Patent
Tabata et al.

(10) Patent No.: US 10,008,804 B2
(45) Date of Patent: Jun. 26, 2018

(54) CONNECTOR DEVICE

(71) Applicant: JAPAN AVIATION ELECTRONICS INDUSTRY, LIMITED, Shibuya-ku, Tokyo (JP)

(72) Inventors: Yuya Tabata, Tokyo (JP); Osamu Hashiguchi, Tokyo (JP)

(73) Assignee: JAPAN AVIATION ELECTRONICS INDUSTRY, LIMITED, Tokyo (JP)

( * ) Notice: Subject to any disclaimer, the term of this patent is extended or adjusted under 35 U.S.C. 154(b) by 0 days. days.

(21) Appl. No.: 15/721,489

(22) Filed: Sep. 29, 2017

(65) Prior Publication Data

US 2018/0145453 A1 May 24, 2018

(30) Foreign Application Priority Data

Nov. 18, 2016 (JP) ..... 2016-225264

(51) Int. Cl.

| | |
|---|---|
| ***H01R 13/53*** | (2006.01) |
| ***H01R 13/629*** | (2006.01) |
| ***H01R 13/641*** | (2006.01) |
| ***H01R 13/11*** | (2006.01) |
| *H01R 107/00* | (2006.01) |
| *H01R 24/76* | (2011.01) |

(52) U.S. Cl.

CPC ..... *H01R 13/62938* (2013.01); *H01R 13/11* (2013.01); *H01R 13/53* (2013.01); *H01R 13/641* (2013.01); *H01R 24/76* (2013.01); *H01R 2107/00* (2013.01); *H01R 2201/26* (2013.01)

(58) Field of Classification Search

CPC ..... H01R 13/6485; H01R 13/53; H01R 24/00
See application file for complete search history.

(56) References Cited

U.S. PATENT DOCUMENTS

| | | | | |
|---|---|---|---|---|
| 6,478,593 | B2 | 11/2002 | Miwa | |
| 6,755,673 | B2 | 6/2004 | Fukushima et al. | |
| 6,982,393 | B2 | 1/2006 | Matsui et al. | |
| 8,192,212 | B2 * | 6/2012 | Casses | B60L 11/1818 439/181 |

FOREIGN PATENT DOCUMENTS

| | | | |
|---|---|---|---|
| JP | 2001250621 | A | 9/2001 |
| JP | 2002343169 | A | 11/2002 |
| JP | 2003178830 | A | 6/2003 |
| JP | 2005142107 | A | 6/2005 |
| JP | 2006339167 | A | 12/2006 |
| JP | 2013143180 | A | 7/2013 |

* cited by examiner

*Primary Examiner* — Briggitte R Hammond
(74) *Attorney, Agent, or Firm* — Holtz, Holtz & Volek PC

(57) ABSTRACT

A connector device comprises a connector and a mating connector which are mateable with each other. The connector comprises a detection terminal having a main contact and a sub-contact for arc discharge. The mating connector comprises a mating detection terminal having a mating main contact and a mating sub-contact for arc discharge. When the connector is connected to the mating connector, the main contact of the detection terminal is brought into contact with the mating main contact of the mating detection terminal. When the connector is disconnected from the mating connector, the main contact is moved along a main path to be disconnected from the mating main contact, and the sub-contact is moved along a sub-path to be apart from the mating sub-contact after the main contact is apart from the mating main contact. The main path and the sub-path are apart from each other.

8 Claims, 26 Drawing Sheets

CONNECTOR DEVICE

CROSS REFERENCE TO RELATED APPLICATIONS

This application is based on and claims priority under 35 U.S.C. § 119 to Japanese Patent Application No. JP2016-225264 filed Nov. 18, 2016, the content of which is incorporated herein in its entirety by reference.

BACKGROUND OF THE INVENTION

This invention relates to a connector device, for example, relates to a connector device which is attached to an electric car or a hybrid car to transmit electric power supplied from a power system.

For example, this type of connector device is disclosed in JP 2002-343169A (Patent Document 1), the content of which is incorporated herein by reference.

As shown in FIGS. 47A, 47B and 47C, Patent Document 1 discloses a power circuit breaker with lever-for-mating-operation (connector device) 90 which comprises a connector 910, a mating connector 950 and a lever 920. The lever 920 is supported by the connector 910 to be operable. The lever 920 is provided with a cam groove 922, and the mating connector 950 is provided with a cam projection 952. The cam projection 952 is inserted in the cam groove 922. The connector 910 is provided with an unillustrated male terminal (power terminal) which is a part of a power circuit. The lever 920 is provided with another unillustrated male terminal for detection of mated state (detection terminal). The mating connector 950 is provided with an unillustrated female terminal (mating power terminal), which is another part of the power circuit, and another unillustrated female terminal for detection of mated state (mating detection terminal).

As can be seen from FIGS. 47A and 47B, when the lever 920 is turned down, the connector 910 is moved downward, and the power terminal and the mating power terminal are connected to each other. As a result, the power circuit is formed. As can be seen from FIGS. 47B and 47C, when the lever 920 is made horizontally slide, the detection terminal and the mating terminal are connected to each other, and electric current flows through the power circuit. When the connector 910 is removed from the mating connector 950, the aforementioned operations are performed in the reverse order. Specifically, first, the lever 920 is made slide in a direction opposite to the sliding direction in the connection operation so that the connection between the detection terminal and the mating terminal is released. Subsequently, the lever is turned up so that the connection between the power terminal and the mating power is released.

The connector device disclosed in Patent Document 1 is, for example, used in an electric car, etc. to transmit large electric current of about 100 A. When such an electric car, etc. is maintained, the connector is several times inserted into and removed from the mating connector. If such maintenance is repeated, the number of insertion and removal of the connector becomes large so that poor electrical connection between the connector and the mating connector is sometimes caused.

SUMMARY OF THE INVENTION

It is therefore an object of the present invention to provide a connector device which facilitates to prevent poor electrical connection between a connector and a mating connector even after a large number of insertion and removal of the connector into and from the mating connector.

An aspect of the present invention provides a connector device comprising a connector and a mating connector which are mateable with each other. The connector comprises a housing, a power terminal and a detection terminal. The power terminal and the detection terminal are held by the housing. The detection terminal has a main contact and a sub-contact for arc discharge. The mating connector comprises a mating housing, a mating power terminal and a mating detection terminal. The mating power terminal and the mating detection terminal are held by the mating housing. The mating detection terminal has a mating main contact and a mating sub-contact for arc discharge. A state of the connector relative to the mating connector is changeable between an unconnected state and an intermediate state and is changeable between the intermediate state and a connected state. When the connector takes the unconnected state, the power terminal is unconnected to the mating power terminal, and the detection terminal is unconnected to the mating detection terminal. When the connector takes the intermediate state, the power terminal is connected to the mating power terminal, but the detection terminal is unconnected to the mating detection terminal. When the connector takes the connected state, the power terminal is connected to the mating power terminal, and the detection terminal is connected to the mating detection terminal at least at the main contact which is in contact with the mating main contact. During a disconnection process in which the state of the connector is changed from the connected state to the intermediate state, the main contact is moved along a main path to be disconnected from the mating main contact, and the sub-contact is moved along a sub-path. In the disconnection process, the sub-contact is in contact with the mating sub-contact at a time of disconnection of the main contact from the mating main contact and is disconnected from the mating sub-contact subsequent to the disconnection of the main contact from the mating main contact. The main path and the sub-path are apart from each other.

In general, when poor electrical connection is caused after a large number of insertion and removal of the connector into and from the mating connector, damage of a terminal due to arc discharge is considered to be one of the causes of the poor electrical connection. Since the connector device according to an aspect of the present invention comprises the power terminal, the detection terminal, the mating power terminal and the mating detection terminal, there is a possibility that these terminals are damaged because of arc discharge. Among them, the power terminal is disconnected from the mating power terminal after the detection terminal is disconnected from the mating detection terminal. Thus, at the time when the power terminal is disconnected from the mating power terminal, no electric current flows between the power terminal and the mating power terminal. Therefore, no substantial arc discharge is generated between the power terminal and the mating power terminal. This fact is also true for the connection of the power terminal to the mating power terminal. On the other hand, because arc discharge might be generated between the detection terminal and the mating detection terminal, some solution for arc discharge is therefore required. In the connector device according to an aspect of the present invention, a solution for arc discharge is provided to the detection terminal and the mating detection terminal as described below.

In the disconnection process of the connector according to an aspect of the present invention, the sub-contact is moved along the sub-path and is disconnected from the mating sub-contact after the disconnection of the main contact from the mating main contact as a result of the movement of the main contact along the main path. Thus, at a certain moment when the main contact is disconnected from the mating main contact, the sub-contact and the mating sub-contact are in contact with each other. Therefore, no arc discharge is generated between the main contact and the mating main contact. This fact is also true in the connection process of the connector. In detail, at a certain moment when the main contact is brought into contact with the mating main contact, the sub-contact and the mating sub-contact are already in contact with each other. Therefore, no arc discharge is generated between the main contact and the mating main contact. Moreover, the main path and the sub-path are apart from each other. Even if arc discharge is generated between the sub-contact and the mating sub-contact at a time when the sub-contact is brought into contact with or disconnected from the mating sub-contact, the main contact and the mating main contact are hardly affected. Thus, the detection terminal and the mating detection terminal can be prevented from being functionally damaged even after a large number of insertion and removal of the connector into and from the mating connector, so that poor electrical connection between the connector and the mating connector can be prevented.

An appreciation of the objectives of the present invention and a more complete understanding of its structure may be had by studying the following description of the preferred embodiment and by referring to the accompanying drawings.

Figure 1:
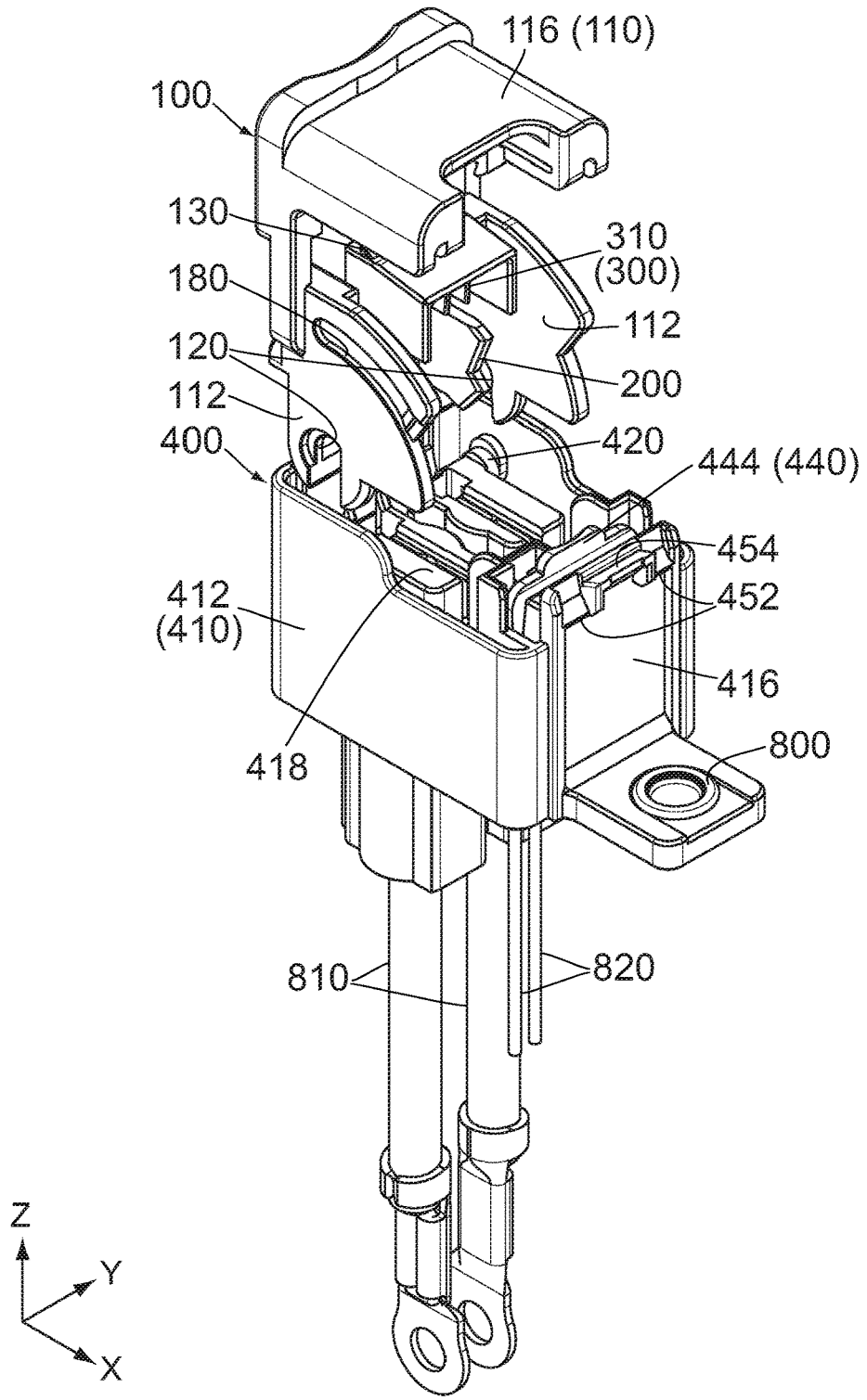
FIG. 1 is a perspective view showing a connector device according to an embodiment of the present invention, wherein a connector thereof is apart from a mating connector thereof.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DESCRIPTION OF PREFERRED EMBODIMENTS

Referring to FIG. 1, a connector device 10 according to an embodiment of the present invention comprises a connector 100 and a mating connector 400. The connector 100 and the mating connector 400 are mateable with each other. The mating connector 400 is attached to an object such as an electric car (not shown) and is connected between a power system (not shown) and a motor (not shown).

Hereafter, explanation is made about a structure of the mating connector 400.

Figure 3:
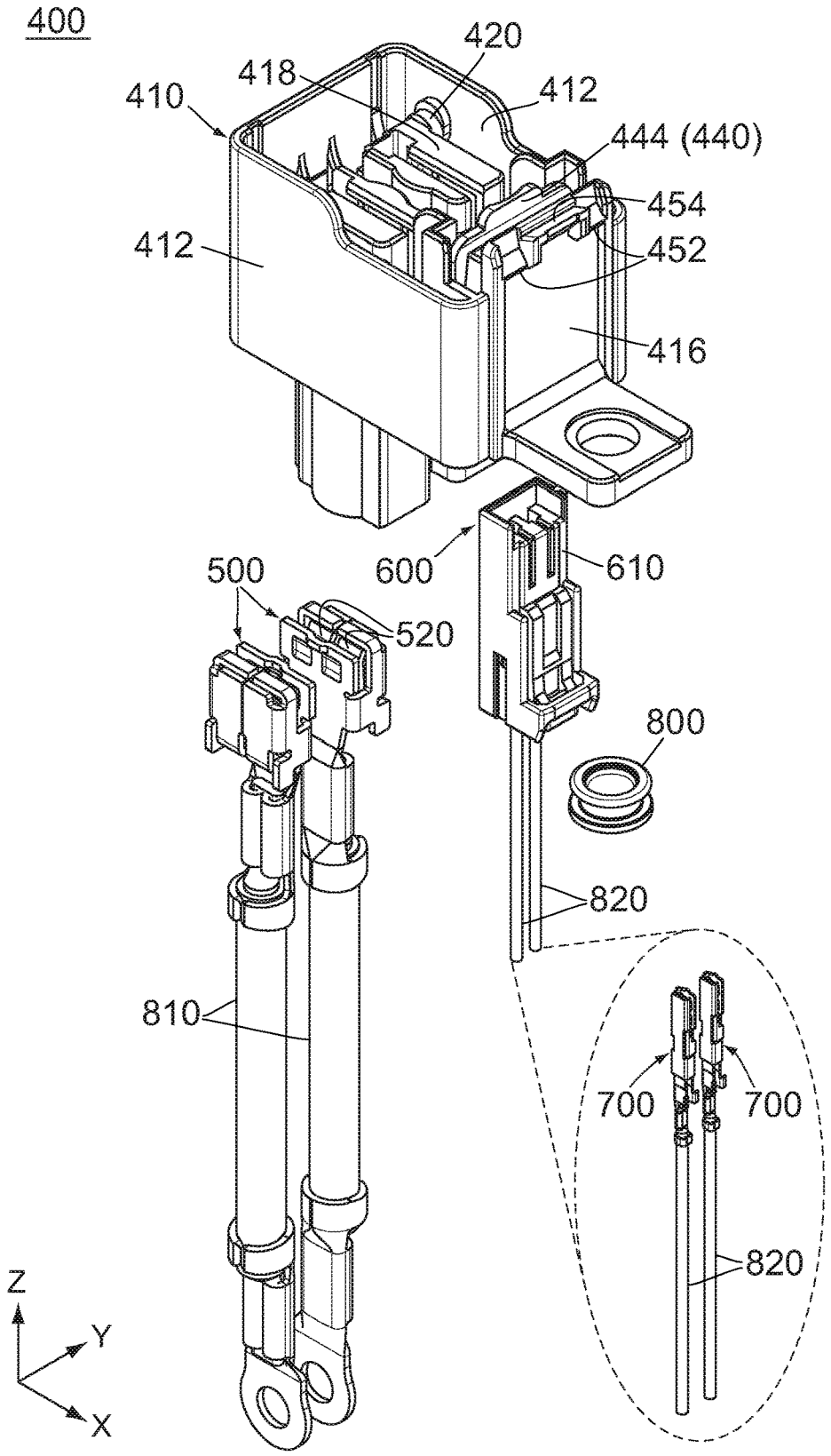
FIG. 3 is an exploded, perspective view showing the mating connector of the connector device of FIG. 1, wherein two mating detection terminals, which are held within a mating sub-connector of the mating connector, are illustrated together with signal cables in an area enclosed by dashed line.

Referring to FIG. 3, the mating connector 400 comprises a mating housing 410 made of insulator, two mating power terminals 500 each made of metal, a mating sub-connector 600, two mating detection terminals 700 each made of metal and an eyelet 800 made of elastomer. As shown in FIG. 1, the eyelet 800 is attached to the mating housing 410.

As shown in FIG. 3, the mating housing 410 has two sidewalls 412, a rear wall 416 and a holding portion 418. The sidewalls 412 are located at opposite sides of the mating housing 410 in a lateral direction (Y-direction). The rear wall 416 is located in the vicinity of a rear end, or the positive X-side end, of the mating housing 410 in a front-rear direction (X-direction). Referring to FIGS. 3 and 13 to 16, the holding portion 418 is a part for holding the mating power terminals 500 and the mating sub-connector 600. The holding portion 418 is located at a middle part of the mating housing 410 in each of the X-direction and the Y-direction.

Figure 13:
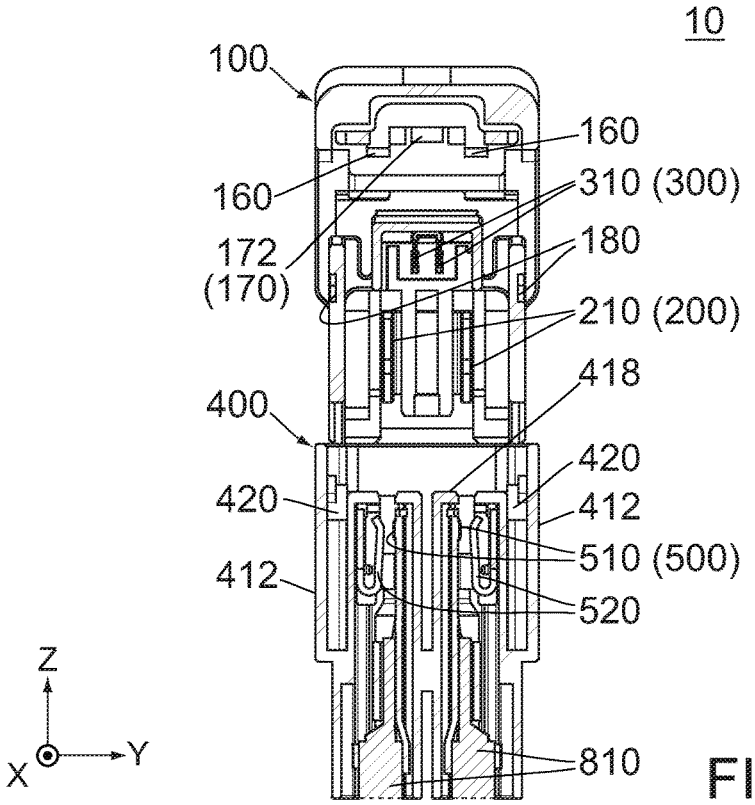
FIG. 13 is a cross-sectional view showing the connector device of FIG. 12, taken along line XIII-XIII, wherein lower parts of power cables and lower parts of the signal cables are not illustrated.
Figure 14:
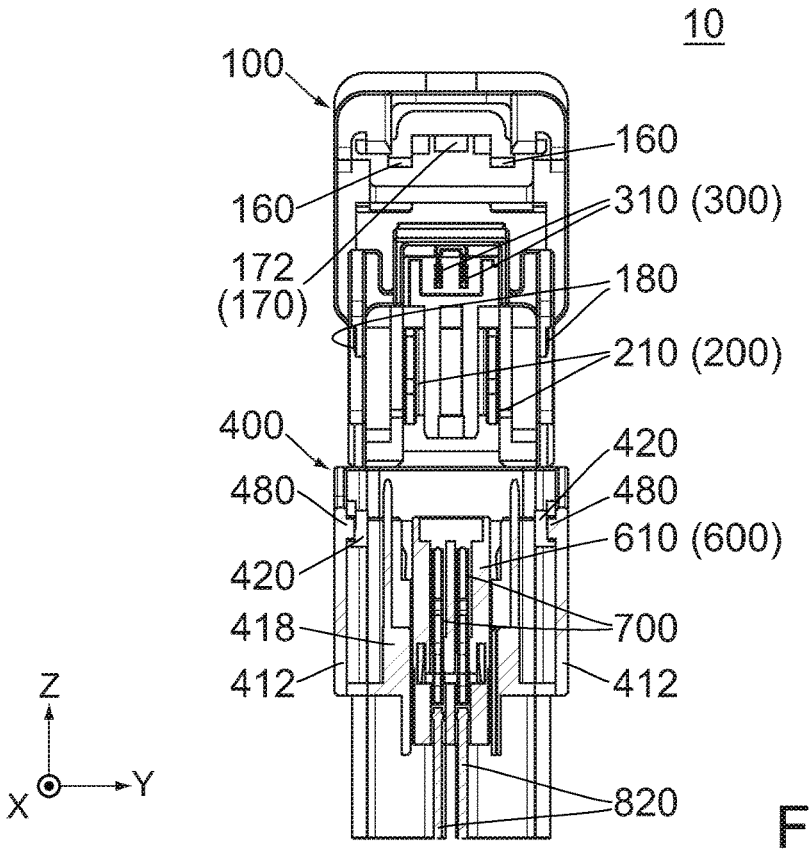
FIG. 14 is a cross-sectional view showing the connector device of FIG. 12, taken along line XIV-XIV, wherein the lower parts of the power cables and the lower parts of the signal cables are not illustrated.

As shown in FIGS. 13 and 14, the mating housing 410 is formed with two mating axis portions (shafts) 420. Each of the mating axis portions 420 is a shaft extending in an axial direction in parallel to the Y-direction. The mating axis portions 420 are provided so as to correspond to the two sidewalls 412, respectively, and are located at positions same as each other in each of the X-direction and an upper-lower direction (Z-direction). The mating axis portions 420 are formed so that the holding portion 418 is located therebetween in the Y-direction. Each of the mating axis portions 420 extends along the Y-direction from an outer surface of the holding portion 418 in the Y-direction to an inner surface of the corresponding sidewall 412 in the Y-direction.

Figure 12:
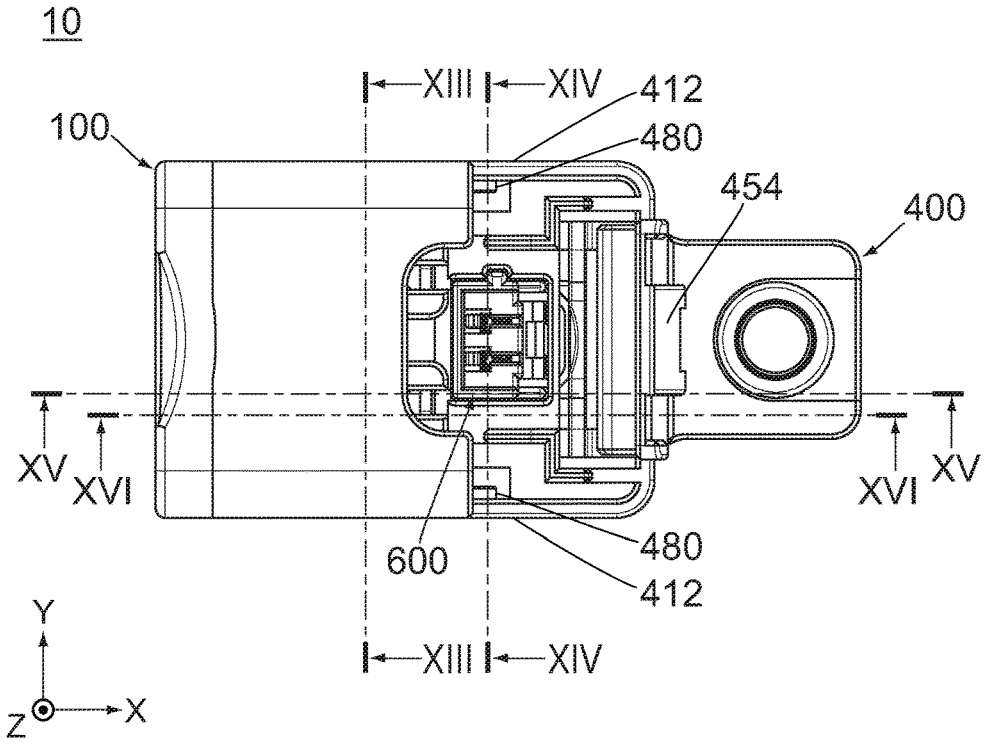
FIG. 12 is a plan view showing the connector device of FIG. 1.

As shown in FIGS. 12 and 14, the mating housing 410 is formed with two mating guide portions 480. Each of the mating guide portions 480 is a projection projecting in the Y-direction. The mating guide portions 480 are provided so as to correspond to the two sidewalls 412, respectively, and are located at positions same as each other in each of the X-direction and the Z-direction. The mating guide portions 480 are formed so that the holding portion 418 is located therebetween in the Y-direction. Each of the mating guide portions 480 projects inward in the Y-direction from the inner surface of the corresponding sidewall 412 in the Y-direction.

Figure 15:
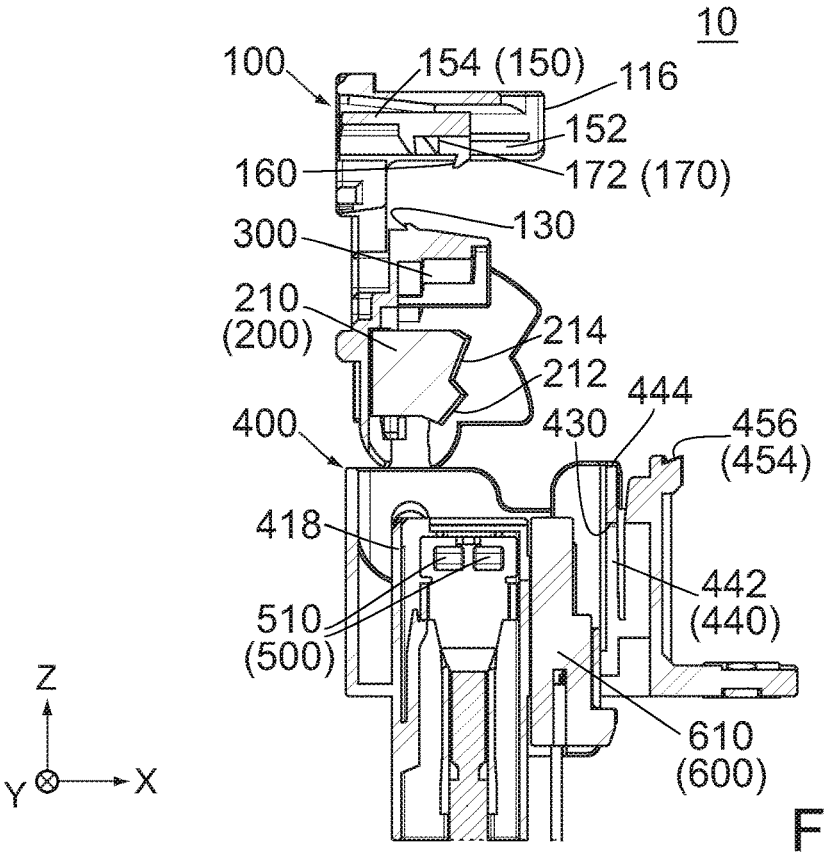
FIG. 15 is a cross-sectional view showing the connector device of FIG. 12, taken along line XV-XV, wherein the lower parts of the power cables and the lower parts of the signal cables are not illustrated.
Figure 16:
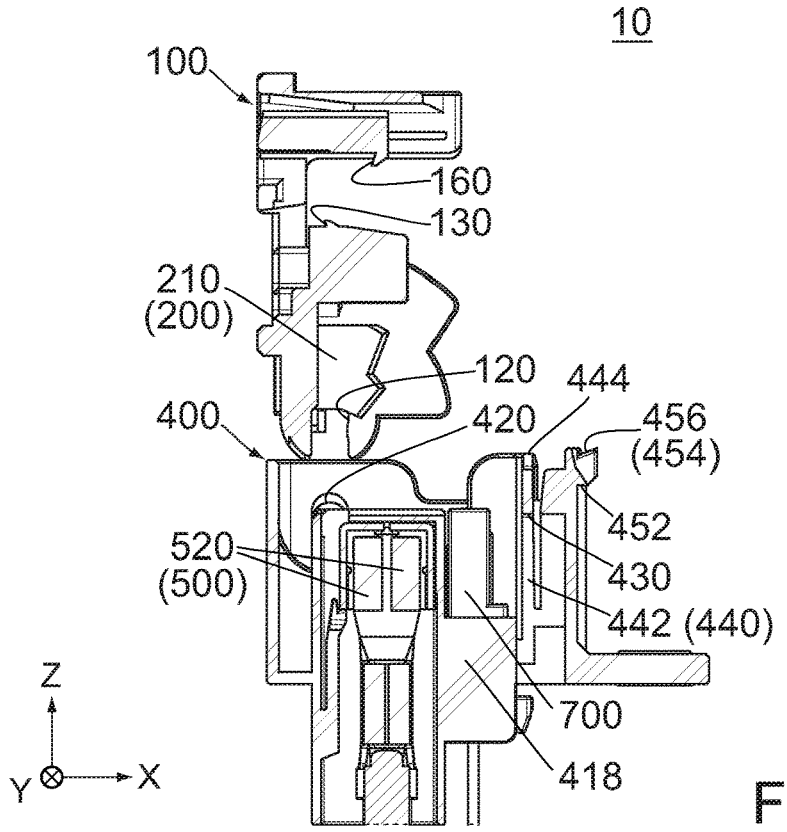
FIG. 16 is a cross-sectional view showing the connector device of FIG. 12, taken along line XVI-XVI, wherein the lower parts of the power cables and the lower parts of the signal cables are not illustrated.

Referring to FIGS. 15 and 16, the mating housing 410 has a first regulation portion 430 and a first release portion 440. The first release portion 440 has first spring portions 442 and a first operation portion 444. Each of the first spring portions 442 extends upward, or in the positive Z-direction, from a part located in the vicinity of a lower end, or the negative Z-side end, of the holding portion 418 so as to be resiliently deformable. Each of the first operation portion 444 and the first regulation portion 430 is supported by the first spring portions 442. Referring to FIGS. 3, 15 and 16, the first operation portion 444 is located at upper ends, or the positive Z-side ends, of the first spring portions 442 and is operable to be moved in the X-direction. The first regulation portion 430 is a surface perpendicular to the Z-direction. The first regulation portion 430 is located under the first operation portion 444 and is movable in the X-direction according to the moving operation of the first operation portion 444.

Referring to FIGS. 3 and 16, the mating housing 410 has two second regulation portions 452 and a temporarily regulation portion 454. Each of the second regulation portions 452 and the temporarily regulation portion 454 projects rearward, or in the positive X-direction, from the rear wall 416. As shown in FIG. 16, a lower surface, or the negative Z-side surface, of each of the second regulation portions 452 is perpendicular to the Z-direction, and an upper surface, or the positive Z-side surface, of each of the second regulation portions 452 is oblique to the Z-direction. The temporarily regulation portion 454 has a lower surface which is oblique to the Z-direction. In addition, the temporarily regulation portion 454 has an upper surface, namely an abutment surface 456, which is oblique to the Z-direction.

Referring to FIGS. 3, 13, 15 and 16, each of the mating power terminals 500 has two contact points 510 and two spring portions 520 which correspond to the contact points 510, respectively. Referring to FIGS. 13 and 15, the contact points 510 are arranged in the X-direction within the mating power terminal 500, and each of the contact points 510 projects outward in the Y-direction. Referring to FIGS. 13 and 16, the spring portions 520 are arranged in the X-direction within the mating power terminal 500, and each of the spring portions 520 protrudes inward in the Y-direction toward the corresponding contact point 510.

As shown in FIG. 3, the mating power terminals 500 are connected to power cables 810, respectively. Referring to FIG. 1, the mating power terminals 500 are held by a front part, or the negative X-side part, of the holding portion 418 of the mating housing 410 so as to be arranged in the Y-direction (see FIGS. 1, 3, 15 and 16). Each of the mating power terminals 500 is fixed to the mating housing 410 and is unmovable relative to the mating housing 410.

Referring to FIG. 3, the mating sub-connector 600 comprises a sub-housing 610 made of insulator. The mating detection terminals 700 are connected to signal cables 820, respectively. Referring to FIG. 14, the mating detection terminals 700 are held by and fixed to the sub-housing 610 so as to be arranged in the Y-direction. The sub-housing 610 is held by and fixed to a rear part, or the positive X-side part, of the holding portion 418 of the mating housing 410. Thus, each of the mating detection terminals 700 is held by the mating housing 410 via the mating sub-connector 600 and is unmovable relative to the mating housing 410.

Figure 4:
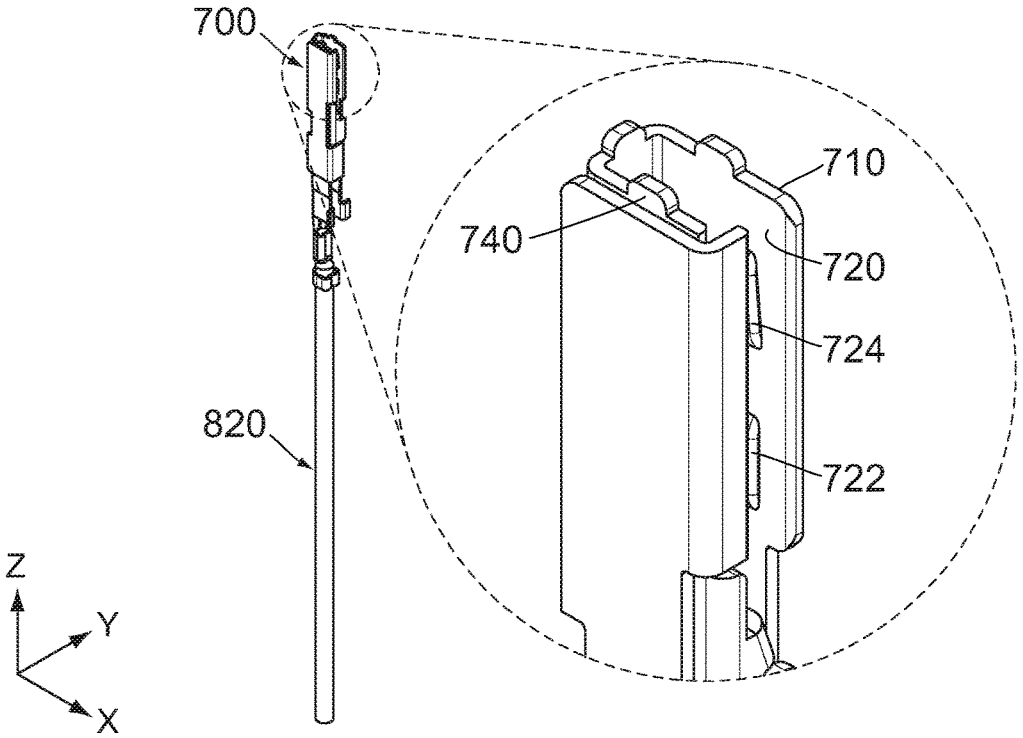
FIG. 4 is a perspective view showing the mating detection terminal of the mating connector and the signal cable of FIG. 3, wherein a part of the mating detection terminal (part enclosed by dashed-line) is enlarged to be illustrated.
Figure 6:
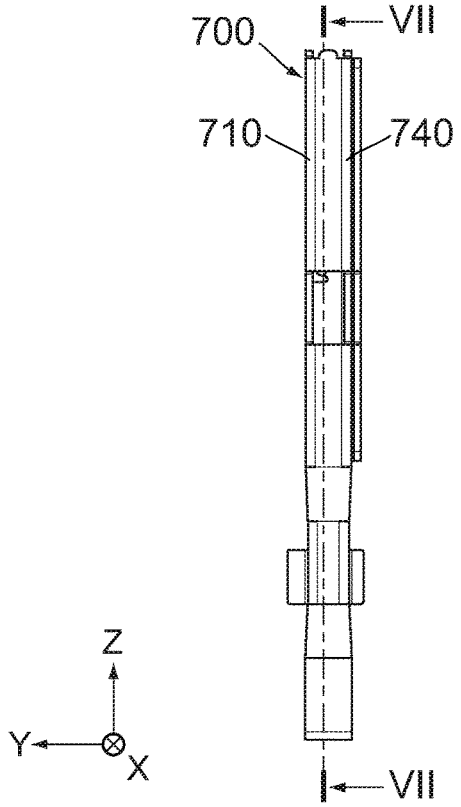
FIG. 6 is a front view showing the mating detection terminal of FIG. 4.

Referring to FIG. 3, the two mating detection terminals 700 have shapes same as each other. Referring to FIGS. 4 and 6, each of the mating detection terminals 700 is a single metal plate with bends and has a connection plate 710 and a spring plate 740. The connection plate 710 and the spring plate 740 face each other in the Y-direction. In detail, the connection plate 710 is located at the positive Y-side of the mating detection terminal 700, and the spring plate 740 is located at the negative Y-side of the mating detection terminal 700.

Figure 7:
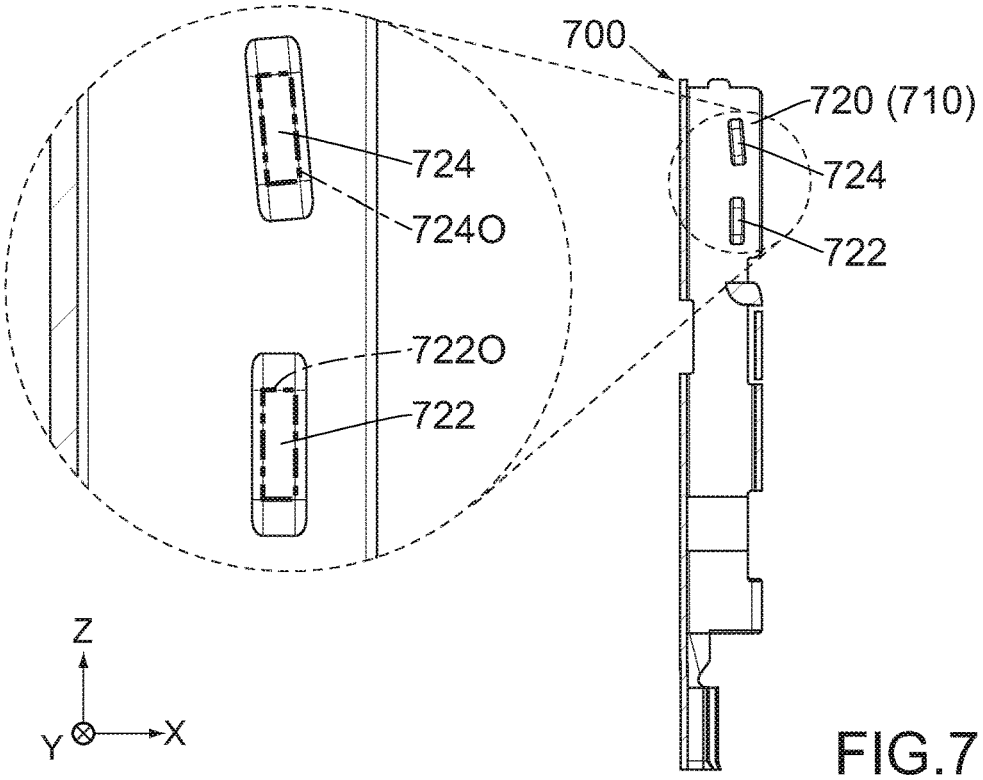
FIG. 7 is a cross-sectional view showing the mating detection terminal of FIG. 6, taken along line VII-VII, wherein a part of the mating detection terminal (part enclosed by dashed-line) is enlarged to be illustrated.

As shown in FIGS. 4 and 7, the mating detection terminal 700 has a connection surface 720. The connection surface 720 is the negative Y-side surface of the connection plate 710. The connection plate 710 extends in parallel to a perpendicular plane perpendicular to the Y-direction, or in parallel to the XZ-plane, and the connection surface 720 extends in a plane in parallel to the XZ-plane.

Figure 5:
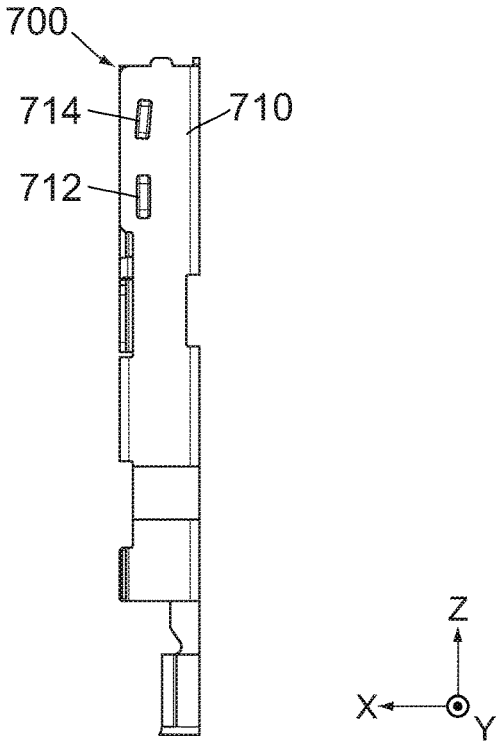
FIG. 5 is a side view showing the mating detection terminal of FIG. 4.
Figure 8:
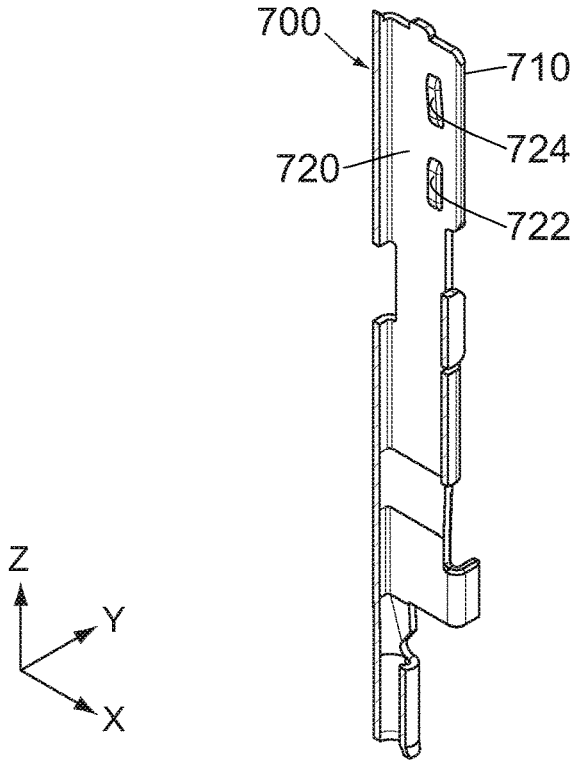
FIG. 8 is a partially cut-away, perspective view showing a connection plate of the mating detection terminal of FIG. 4.

As shown in FIGS. 4, 7 and 8, the mating detection terminal 700 has a mating main contact 722 and a mating sub-contact 724. Each of the mating main contact 722 and the mating sub-contact 724 is provided on the connection surface 720. Thus, the surface on which the mating main contact 722 is provided is same as the surface on which the mating sub-contact 724 is provided. Moreover, the mating sub-contact 724 is located above the mating main contact 722. Referring to FIG. 5, the connection plate 710 is formed with two recessed portions 712 and 714. Referring to FIGS. 5, 7 and 8, each of the recessed portions 712 and 714 is recessed in the negative Y-direction so that the mating main contact 722 and the mating sub-contact 724 are formed to project.

As shown in FIG. 7, each of the mating main contact 722 and the mating sub-contact 724 is an end surface of a projection which projects from the connection surface 720 in the negative Y-direction. In detail, the mating main contact 722 is an inner part enclosed by an outer edge 7220 illustrated in chain dotted line, including the outer edge 7220, and the mating sub-contact 724 is an inner part enclosed by an outer edge 724O illustrated in chain dotted line, including the outer edge 724O. The mating main contact 722 extends along the Z-direction, and the mating sub-contact 724 extends along a direction slightly oblique to the Z-direction. Thus, an extending direction of the mating sub-contact 724 intersects with another extending direction of the mating main contact 722.

Figure 9:
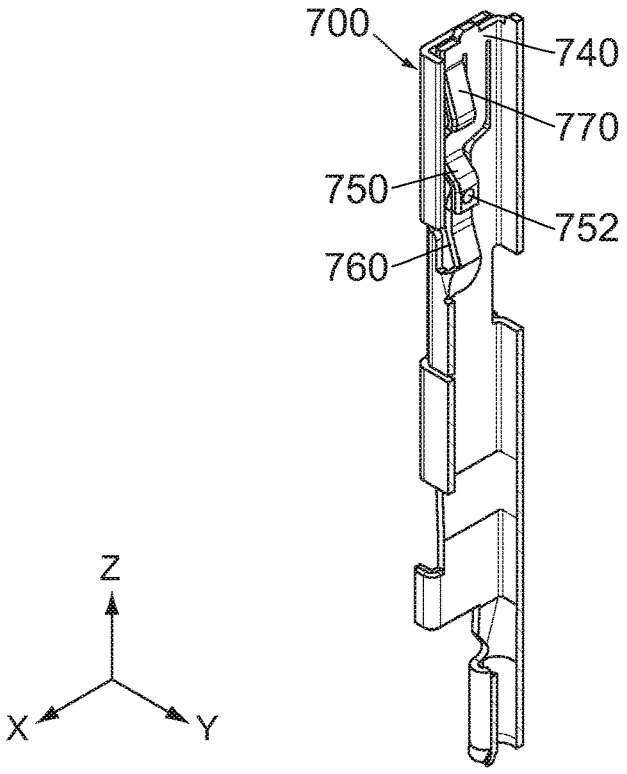
FIG. 9 is a partially cut-away, perspective view showing a spring plate of the mating detection terminal of FIG. 4.
Figure 10:
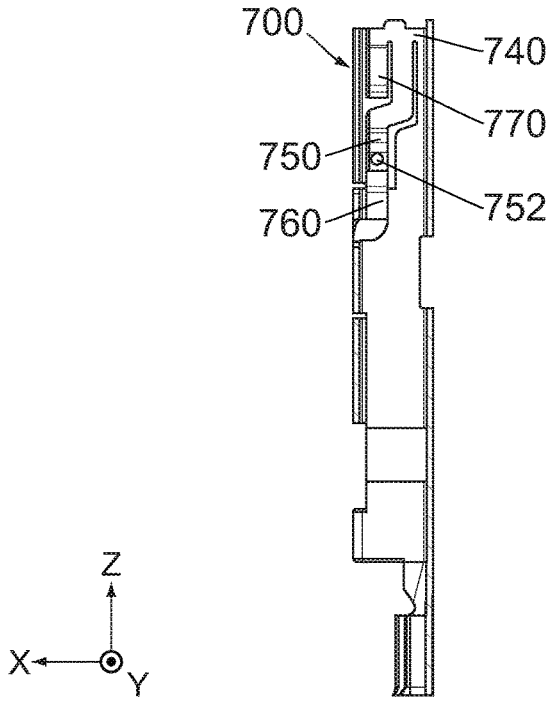
FIG. 10 is a side view showing the spring plate of FIG. 9.
Figure 11:
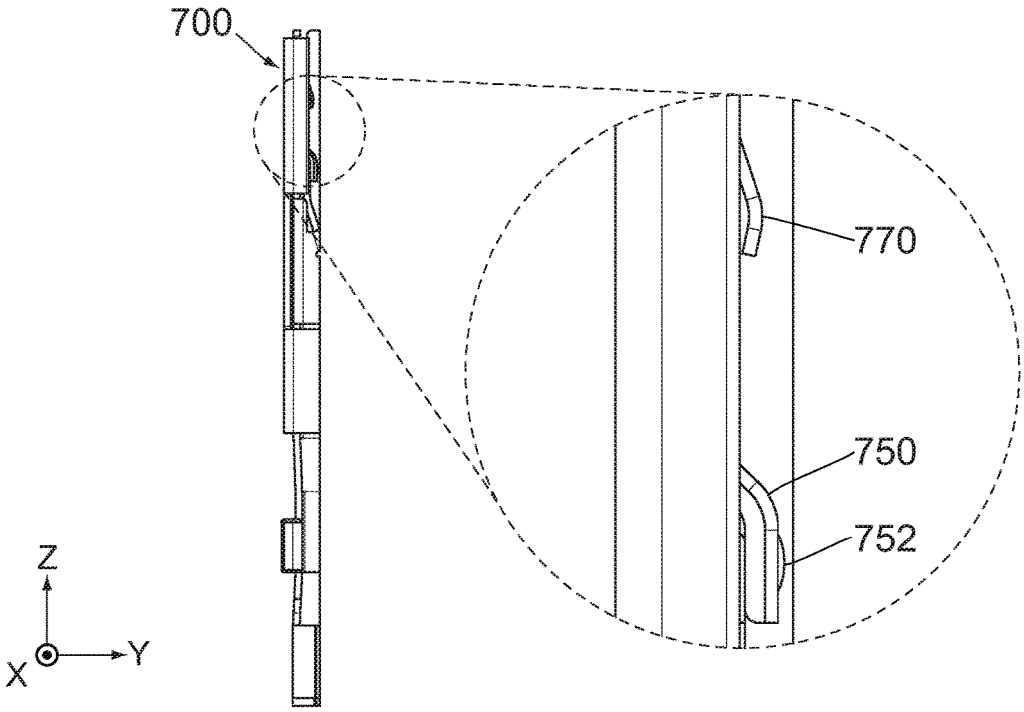
FIG. 11 is a rear view showing the spring plate of FIG. 9, wherein a part of the spring plate (part enclosed by dashed-line) is enlarged to be illustrated.

As shown in FIGS. 9 to 11, the spring plate 740 is formed with a main spring 750, an auxiliary spring 760 and a sub-spring (pressing member) 770. Each of the main spring 750, the auxiliary spring 760 and the sub-spring 770 is supported in a cantilever manner and is resiliently deformable.

Referring to FIGS. 8 and 9, the main spring 750 extends downward as a whole, or extends in the negative Z-direction, from a fixed end which is its upper end. The main spring 750 has a lower end which extends downward while protruding in the positive Y-direction. The lower end of the main spring 750 is formed with a pressure projection 752. The pressure projection 752 faces the mating main contact 722 in the Y-direction and projects toward the mating main contact 722 in the positive Y-direction. The auxiliary spring 760 extends upward from a fixed end which is its lower end. The auxiliary spring 760 has an upper end which is located toward the negative Y-side of the lower end of the main spring 750. The sub-spring 770 extends downward from a fixed end which is its upper end while protruding in the positive Y-direction. The sub-spring 770 has a lower end which faces the mating sub-contact 724 in the Y-direction and protrudes toward the mating sub-contact 724.

Hereafter, explanation is made about a structure of the connector 100.

Figure 2:
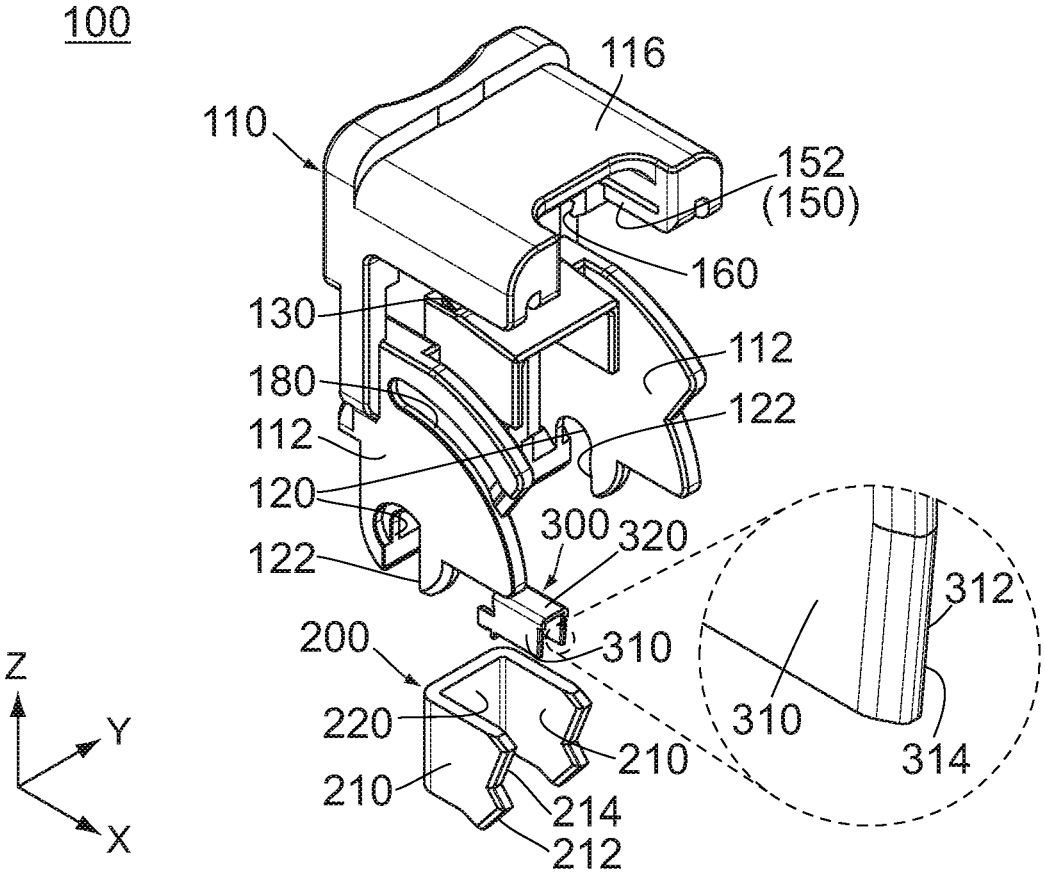
FIG. 2 is an exploded, perspective view showing the connector of the connector device of FIG. 1, wherein a part of a detection terminal (part enclosed by dashed-line) is enlarged to be illustrated.

Referring to FIG. 2, the connector 100 comprises a housing 110 made of insulator, a power terminal 200 made of metal and a detection terminal 300 made of metal.

The housing 110 has two side portions 112. The side portions 112 are located at opposite sides of the housing 110 in the Y-direction, respectively. Each of the side portions 112 extends roughly in a plane in parallel to the XZ-plane. The housing 110 is formed with two axis portions (bearings) 120. The axis portions 120 is provided so as to correspond to the two side portions 112, respectively. Each of the axis portions 120 is a bearing which is a hole passing through the corresponding side portion 112 in the Y-direction. The two axis portions 120 are located at positions same as each other in each of the X-direction and the Z-direction.

Referring to FIG. 1, when the mating axis portions 420 extending along the Y-direction (axial direction) are combined to the aforementioned axis portions 120, the connector 100 of the present embodiment is pivotally movable about the central axis formed of the mating axis portions 420 and the axis portions 120. Each part of the connector 100 changes its position in the XZ-plane as the connector 100 is pivotally moved. In the following explanation, the positional feature of each part of the connector 100 in the XZ-plane is described by using "radial direction" and "circumference direction" as necessary. In the following explanation, the radial direction is a direction along a radius of an imaginary circle around the axis portion 120 in the XZ-plane, and the circumference direction is another direction along the circumference of the imaginary circle. Each of the radial direction and the circumference direction is perpendicular to the Y-direction. In addition, the radial direction and the circumference direction are perpendicular to each other.

Referring to FIG. 2, the housing 110 is formed with two guide channels 122. The guide channels 122 are provided on the two side portions 112, respectively, so as to correspond to the two axis portion 120, respectively. Each of the guide channels 122 passes through the corresponding side portion 112 in the Y-direction. Each of the guide channels 122 extends in the radial direction, or downward in FIG. 2, from the corresponding axis portion 120 and opens at an end of the corresponding side portion 112, or a lower end of the corresponding side portion 112 in FIG. 2. The two guide channels 122 are located at positions same as each other in each of the X-direction and the Z-direction.

Referring to FIGS. 2, 13 and 14, the housing 110 is formed with two guide portions 180. The guide portions 180 are provided so as to correspond to the two side portions 112, respectively. Each of the guide portions 180 is a groove, which is formed on the corresponding side portion 112 to be recessed inward in the Y-direction, and has an arch-shape in the XZ-plane. The two guide portions 180 are located at positions same as each other in each of the X-direction and the Z-direction.

Referring to FIGS. 2, 15 and 16, the housing 110 has a first regulated portion 130. The first regulated portion 130 is a projection projecting outward in the radial direction, or upward in each of FIGS. 15 and 16. In the first regulated portion 130 illustrated in each of FIGS. 15 and 16, each of the positive X-side surface and the negative X-side surface is oblique to the X-direction.

As shown in FIG. 2, the housing 110 has a base portion 116. The base portion 116 is apart from the side portions 112 outward in the radial direction. The base portion 116 illustrated in FIG. 2 is located above the side portions 112 and extends roughly along a plane in parallel to the XY-plane.

Referring to FIGS. 2, 14 and 15, the housing 110 has a second release portion 150, two second regulated portions 160 and a temporarily regulated portion 170. Referring to FIG. 15, the second release portion 150 has two second spring portions 152 and a second operation portion 154.

Referring to FIGS. 2 and 15, each of the second spring portions 152 extends in parallel to the base portion 116 from a part located in the vicinity of an end, or the positive X-side end in FIGS. 2 and 15, of the base portion 116 of the housing 110 so as to be resiliently deformable. The second operation portion 154 are supported by the two second spring portions 152. In detail, the second operation portion 154 couples ends, or the negative X-side ends in FIGS. 2 and 15, of the two second spring portions 152 to each other in the Y-direction and is operable to be moved in the radial direction.

Referring to FIG. 15, the second regulated portions 160 are supported by the second spring portions 152, respectively, and are movable in the radial direction according to the moving operation of the second operation portion 154. Each of the second regulated portions 160 is a projection which projects inward in the radial direction, or in the negative Z-direction in FIG. 15, from the corresponding second spring portion 152. In the second regulated portion 160 illustrated in FIG. 15, each of the positive X-side surface and the negative X-side surface is oblique to the X-direction.

The temporarily regulated portion 170 is supported by the second spring portions 152 and is movable in the radial direction according to the moving operation of the second operation portion 154. The temporarily regulated portion 170 is a projection projecting inward in the radial direction, or in the negative Z-direction in FIG. 15, from the second release portion 150. In the temporarily regulated portion 170 illustrated in FIG. 15, an abutment surface 172, or the positive X-side surface, is perpendicular to the X-direction, and the negative X-side surface is oblique to the X-direction.

Referring to FIG. 2, the power terminal 200 has two blades 210 and a coupling portion 220. Each of the blades 210 has two contact ends 212 and 214. Referring to FIG. 15, the contact ends 212 and 214 are apart from each other in each of the radial direction and the circumference direction, and each of the contact ends 212 and 214 linearly extends roughly along the radial direction (see FIGS. 15 and 27). The contact end 212 is located inward in the radial direction relative to the contact end 214. The coupling portion 220 couples the two blades 210 to each other in the Y-direction. Referring to FIGS. 13 and 14, the power terminal 200 is held by the housing 110 so that the blades 210 are arranged in the Y-direction. The power terminal 200 is fixed to the housing 110 and is unmovable relative to the housing 110.

As shown in FIG. 2, the detection terminal 300 has two connection portions 310 and a coupling portion 320. The coupling portion 320 couples the two connection portions 310 to each other in the Y-direction. Referring to FIGS. 13 and 14, the detection terminal 300 is held by the housing 110 so that the connection portions 310 are arranged in the Y-direction. The detection terminal 300 is fixed to the housing 110 and is unmovable relative to the housing 110.

As shown in FIG. 2, each of the connection portions 310 of the detection terminal 300 has a main contact 312 and a sub-contact 314. In the present embodiment, each of the main contact 312 and the sub-contact 314 is a part of the common connection portion 310, and no visible boundary is provided between the main contact 312 and the sub-contact 314.

Figure 32:
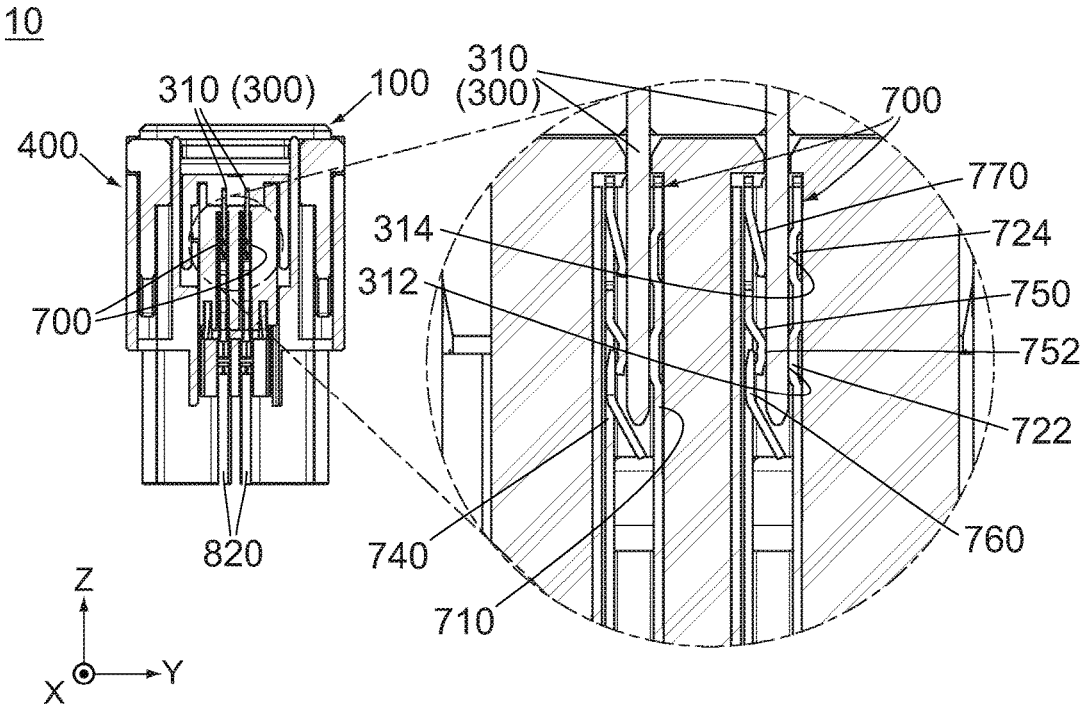
FIG. 32 is a cross-sectional view showing the connector device of FIG. 30, taken along line XXXII-XXXII, wherein contact parts between the detection terminals and the mating detection terminals and therearound (parts enclosed by chain dotted line) are illustrated to be enlarged.

Referring to FIG. 32, the main contacts 312 of the detection terminal 300 and the mating main contacts 722 of the mating detection terminals 700 are parts for electrically connecting the detection terminal 300 and the mating detection terminals 700 with each other. According to the present embodiment, the flat plate-like connection portion 310 has a contact part that is brought into contact with the mating main contact 722, and this contact part works as the main contact 312. The sub-contacts 314 of the detection terminal 300 and the mating sub-contacts 724 of the mating detection terminals 700 are parts for generating arc discharge at a time when the electrical connection between the detection terminal 300 and the mating detection terminals 700 is released. In other words, each of the sub-contacts 314 and the mating sub-contacts 724 is a part for arc discharge. According to the present embodiment, the flat plate-like connection portion 310 has another contact part that is brought into contact with the mating sub-contact 724, and this contact part works as the sub-contact 314.

Hereafter, explanation is made about a mating operation in which the connector 100 is operated to be mated with the mating connector 400 and a removal operation in which the connector 100 is operated to be removed from the mating connector 400.

Figure 29:
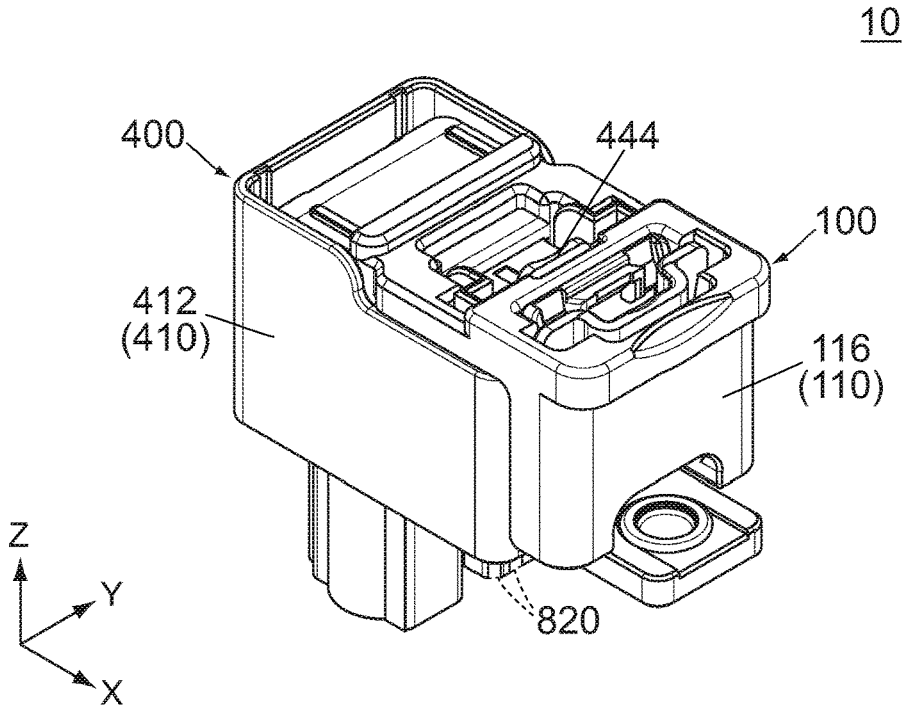
FIG. 29 is another perspective view showing the connector device of FIG. 1, wherein the connector is under a connected state, and the lower parts of the power cables and the lower parts of the signal cables are not illustrated.
Figure 30:
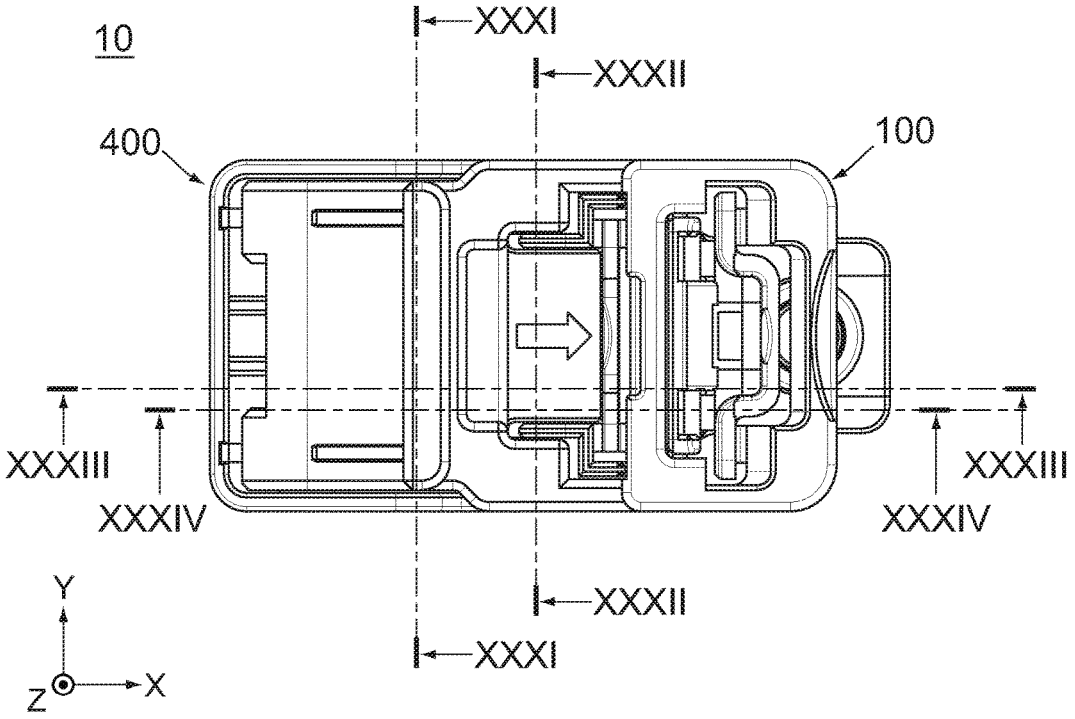
FIG. 30 is a plan view showing the connector device of FIG. 29.

As can be seen from FIGS. 1, 17, 22, 29 and 35, when the axis portions 120 and the mating axis portions 420 are combined with each other, the connector 100 is turnable on the mating axis portions 420 relative to the mating connector 400 between an open position (position shown in FIG. 17) and a closed position (position shown in FIG. 29). The connector 100 at the open position is removal from the mating connector 400, and the connector 100 at the closed position is completely mated with the mating connector 400.

Figure 17:
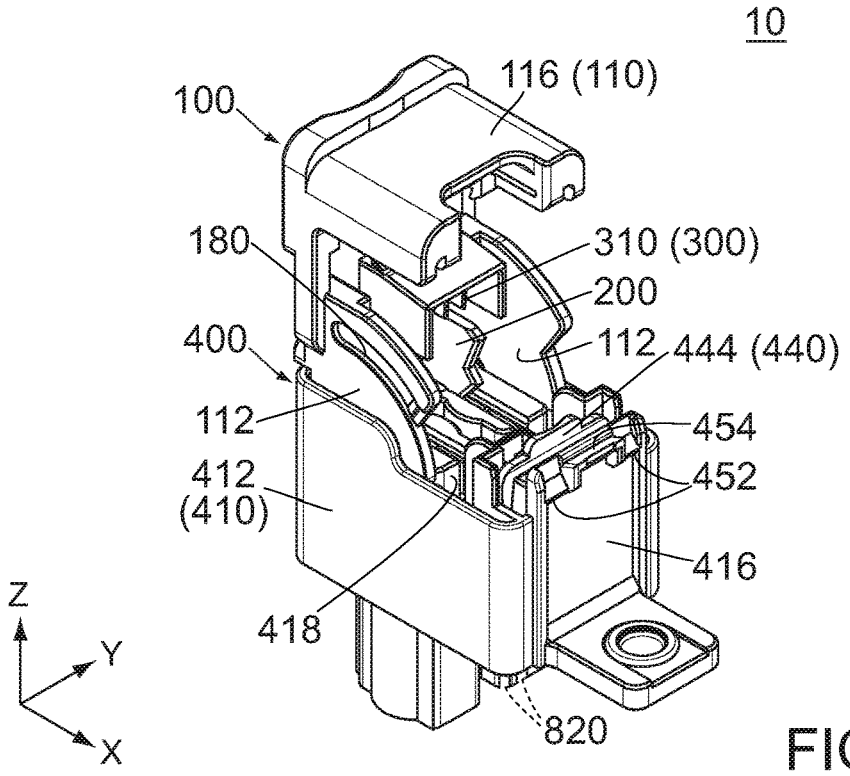
FIG. 17 is another perspective view showing the connector device of FIG. 1, wherein the connector is under an unconnected state, and the lower parts of the power cables and the lower parts of the signal cables are not illustrated.
Figure 18:
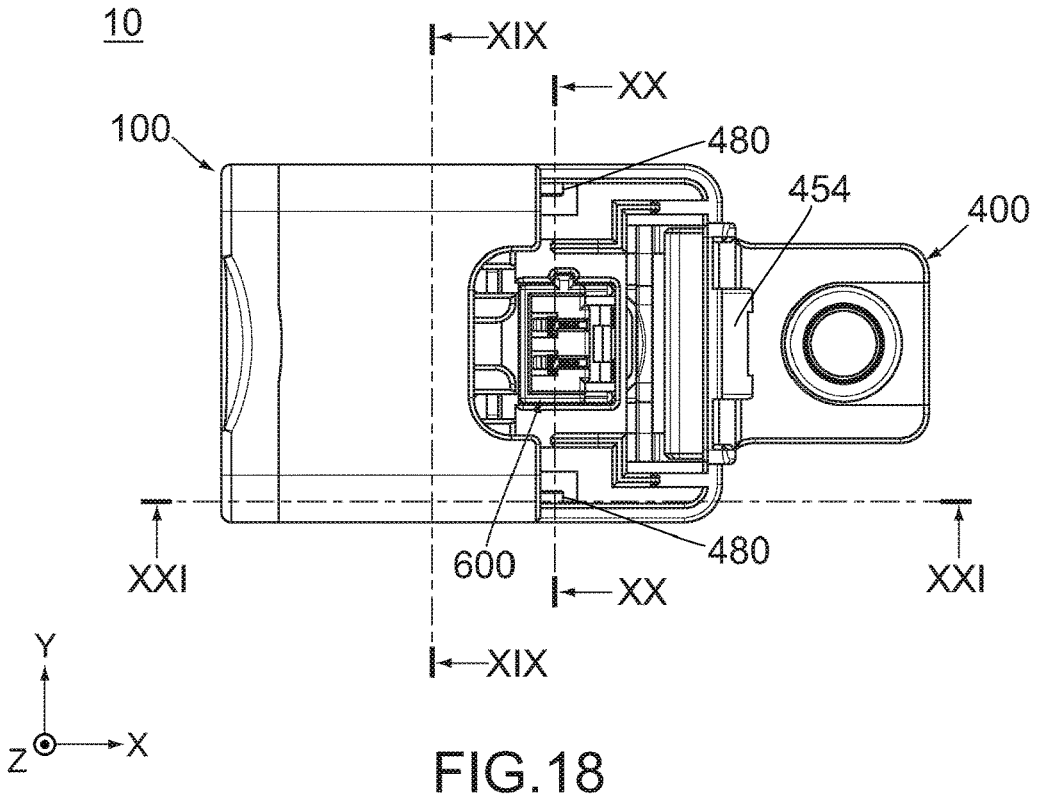
FIG. 18 is a plan view showing the connector device of FIG. 17.
Figure 22:
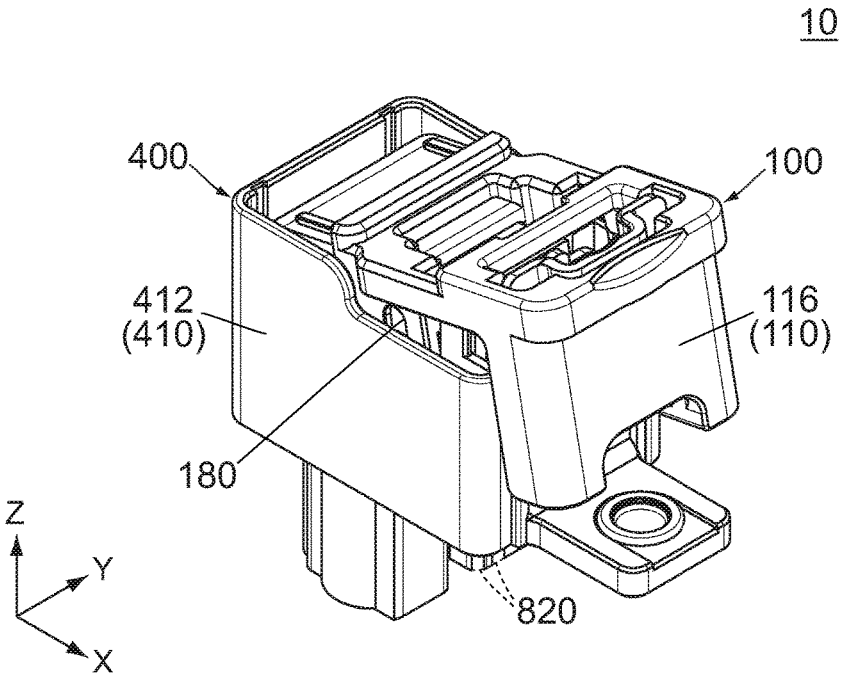
FIG. 22 is another perspective view showing the connector device of FIG. 1, wherein the connector is under a first intermediate state, and the lower parts of the power cables and the lower parts of the signal cables are not illustrated.
Figure 23:
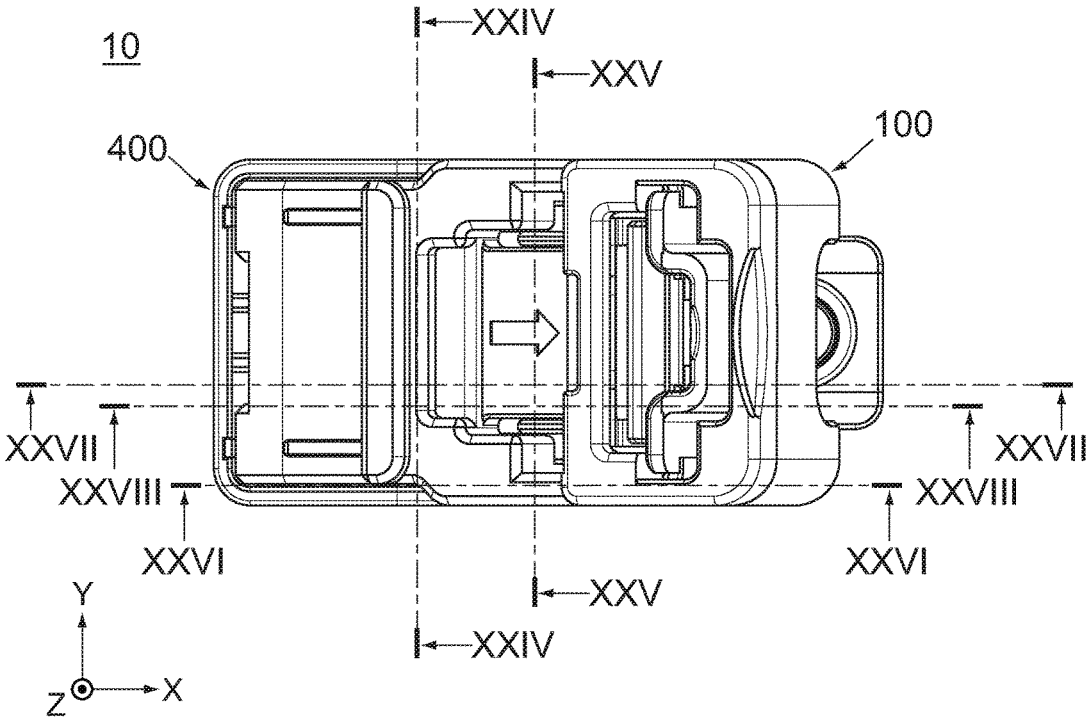
FIG. 23 is a plan view showing the connector device of FIG. 22.
Figure 35:
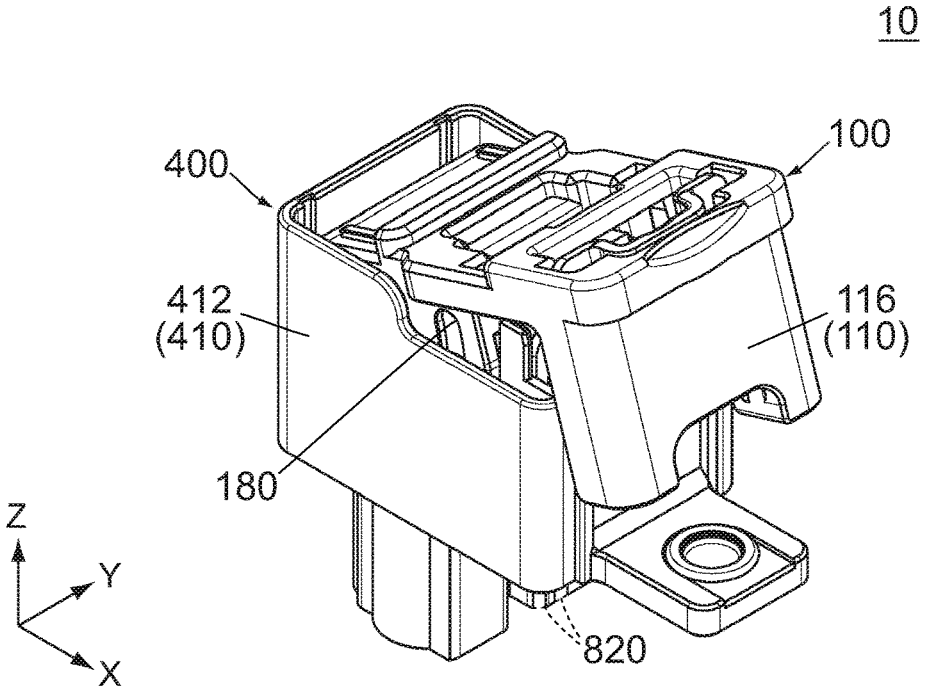
FIG. 35 is another perspective view showing the connector device of FIG. 1, wherein the connector is under a second intermediate state (intermediate state), and the lower parts of the power cables and the lower parts of the signal cables are not illustrated.
Figure 36:
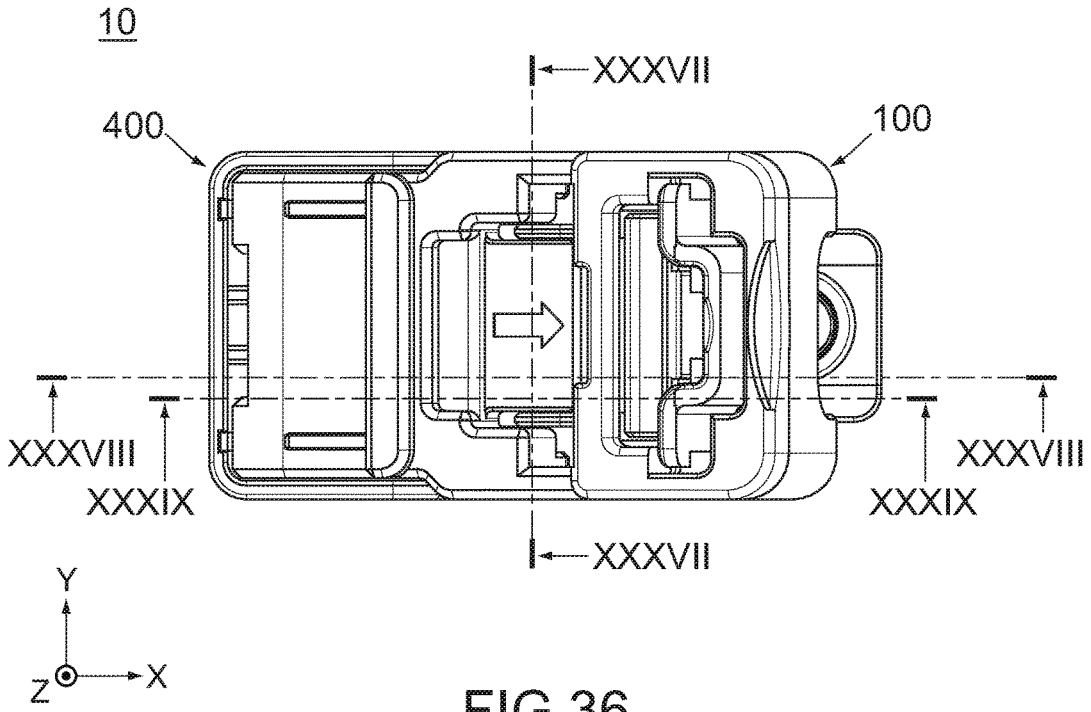
FIG. 36 is a plan view showing the connector device of FIG. 35.

In the following explanation, the state of the connector 100 which is located at the open position shown in FIG. 17 is referred to as "unconnected state", and the state of the connector 100 which is located at the closed position shown in FIG. 29 is referred to as "connected state". In addition, the state of the connector 100 which is located at a position shown in FIG. 22 is referred to as "first intermediate state", and the state of the connector 100 which is located at a position shown in FIG. 35 is referred to as "second intermediate state" or simply "intermediate state". As described below, the state of the connector 100 relative to the mating connector 400 is changeable between the unconnected state and the second intermediate state (intermediate state) via the first intermediate state and is changeable between the second intermediate state (intermediate state) and the connected state.

In the following explanation, when necessary, a radial direction and a circumference direction about the mating axis portion 420 are used to specify a position, etc. of each portion of the connector device 10 in the XZ-plane. The radial direction is a direction along a radius of an imaginary circle around the mating axis portion 420 in the XZ-plane, and the circumference direction is another direction along a circumference of the imaginary circle in the XZ-plane. In addition, in the following explanation, each of "clockwise turn" and "counterclockwise turn" specifies a turning direction of the connector 100 of the connector device 10 that is seen along the positive Y-direction.

Referring to FIGS. 1, 17, 22, 29 and 35, when the connector 100 of the present embodiment is turned relative to the mating connector 400, the state of the connector 100 is changed among the unconnected state, the first intermediate state, the second intermediate state (intermediate state) and the connected state in this order. According to the present embodiment, the axis portion 120 of the connector 100 is the bearing, and the mating axis portion 420 of the mating connector 400 is the shaft. However, the present invention is not limited thereto. For example, the axis portion 120 may be the shaft, and the mating axis portion 420 may be the bearing. Thus, one of the axis portion 120 and the mating axis portion 420 may be the shaft, and a remaining one of the axis portion 120 and the mating axis portion 420 may be the bearing.

Figure 19:
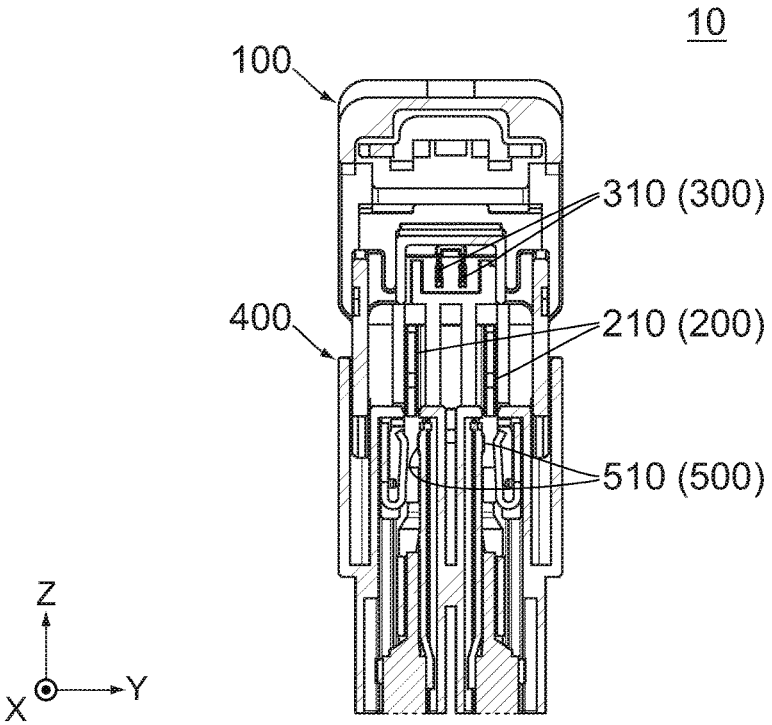
FIG. 19 is a cross-sectional view showing the connector device of FIG. 18, taken along line XIX-XIX.
Figure 20:
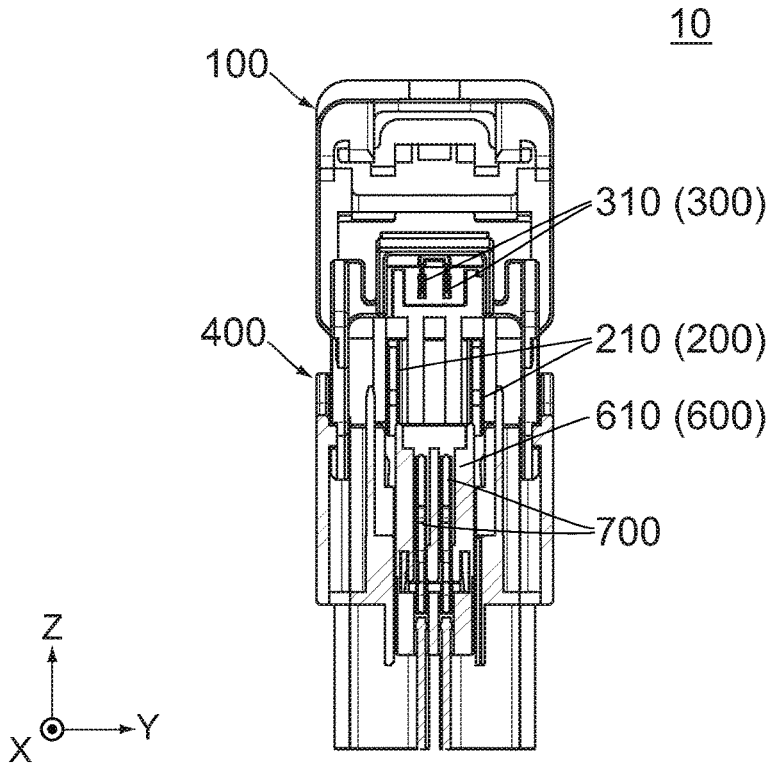
FIG. 20 is a cross-sectional view showing the connector device of FIG. 18, taken along line XX-XX.
Figure 21:
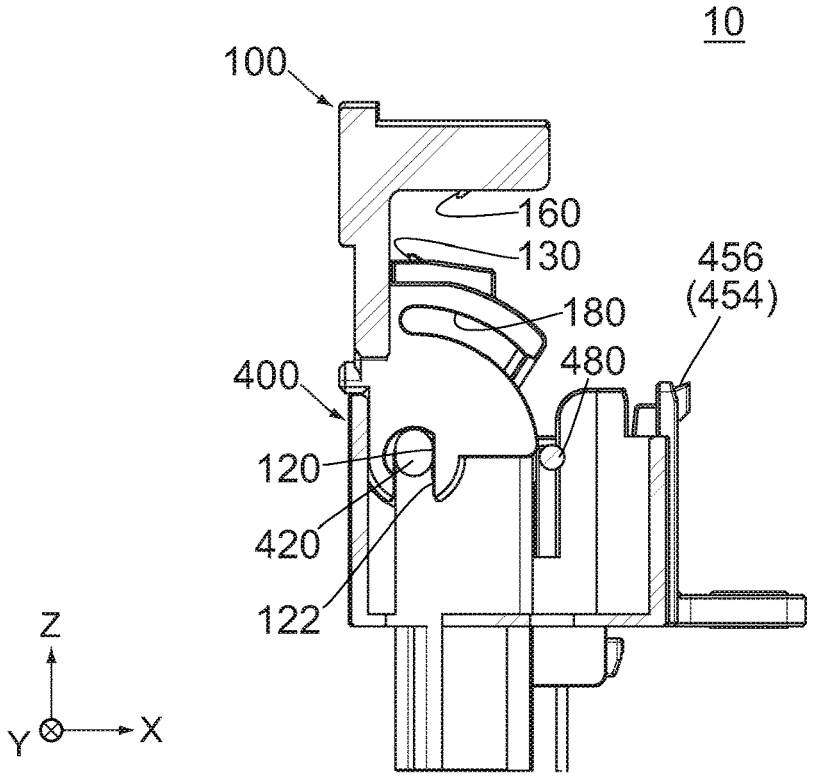
FIG. 21 is a cross-sectional view showing the connector device of FIG. 18, taken along line XXI-XXI.

Referring to FIGS. 1 and 17 to 21, the connector 100, which is in a standing posture relative to the mating connector 400, is attached to the mating connector 400 along the negative Z-direction from above the mating connector 400. This operation changes the state of the connector 100 from a separated state, in which the connector 100 is apart from the mating connector 400 as shown in FIG. 1, to the unconnected state in which the connector 100 is partially mated with the mating connector 400 as shown in FIGS. 17 to 21. Referring to FIG. 21, while the state of the connector 100 changes from the separated state to the unconnected state, the guide channels 122 receive the mating axis portions 420, respectively, and guide the mating axis portions 420 to the axis portions 120 along the Z-direction, respectively.

As shown in FIG. 19, when the connector 100 takes the unconnected state, the power terminal 200 is unconnected to the mating power terminals 500. Meanwhile, as shown in FIG. 20, the detection terminal 300 is unconnected to the mating detection terminals 700.

Figure 24:
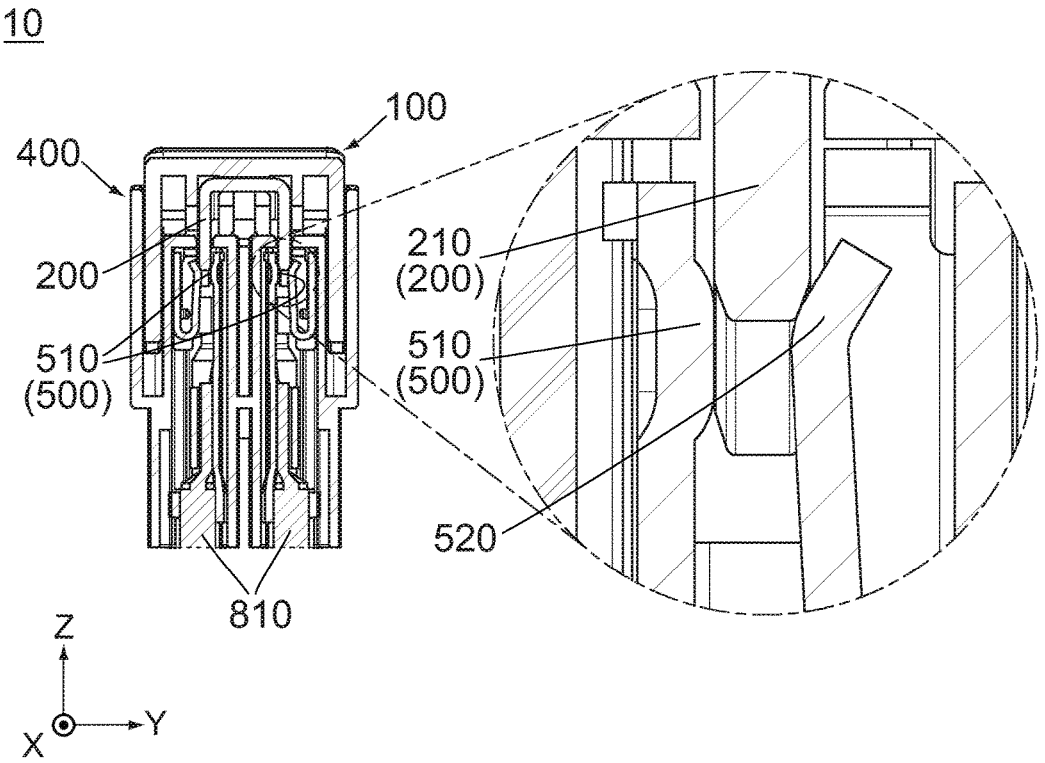
FIG. 24 is a cross-sectional view showing the connector device of FIG. 23, taken along line XXIV-XXIV, wherein contact parts between a power terminal and a mating power terminal and therearound (parts enclosed by chain dotted line) are illustrated to be enlarged.
Figure 25:
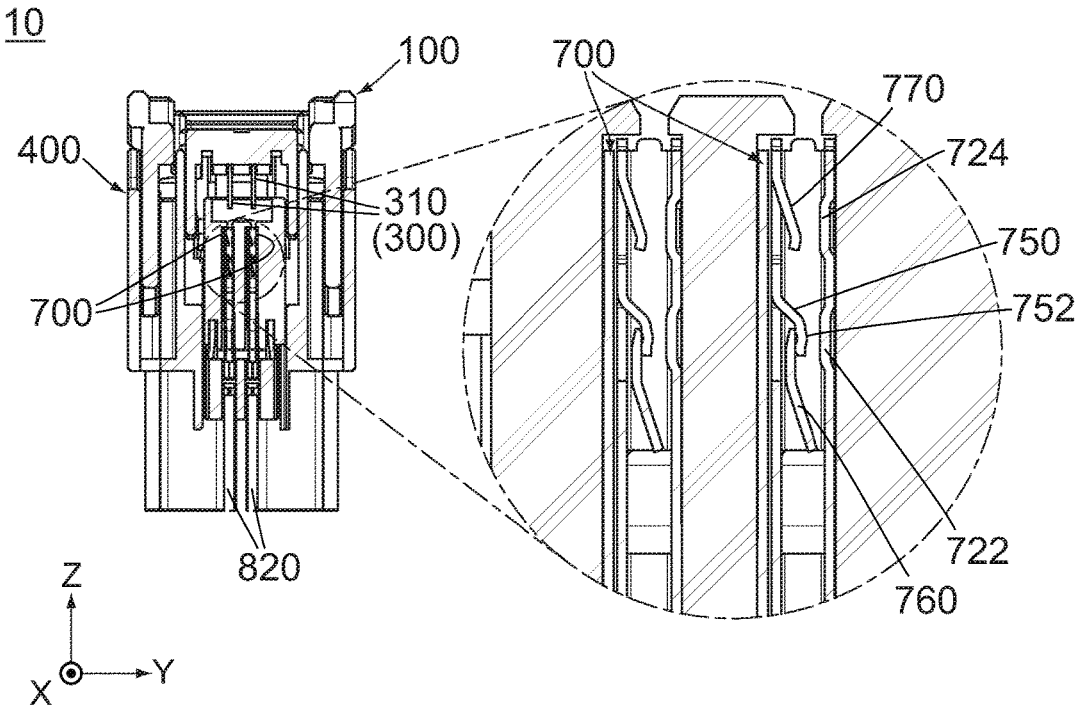
FIG. 25 is a cross-sectional view showing the connector device of FIG. 23, taken along line XXV-XXV, wherein upper parts of the mating detection terminals and therearound (parts enclosed by chain dotted line) are illustrated to be enlarged.
Figure 26:
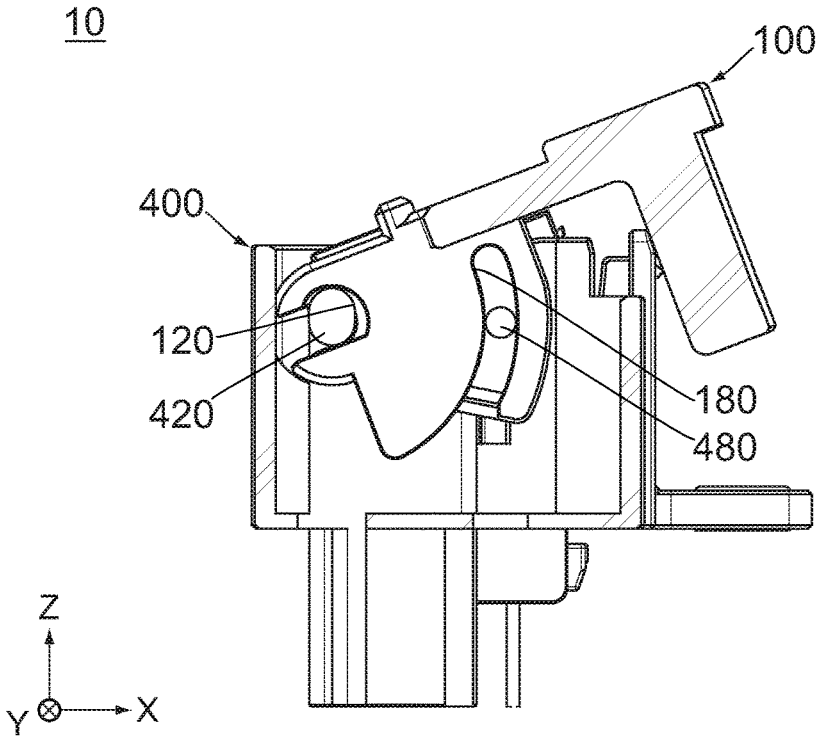
FIG. 26 is a cross-sectional view showing the connector device of FIG. 23, taken along line XXVI-XXVI.
Figure 27:
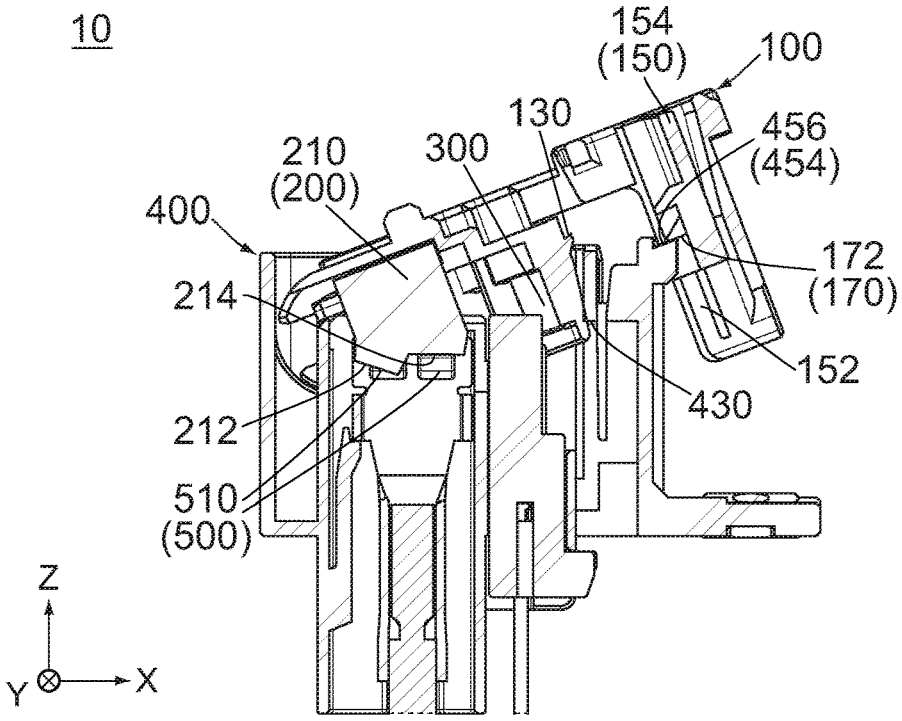
FIG. 27 is a cross-sectional view showing the connector device of FIG. 23, taken along line XXVII-XXVII.

Referring to FIGS. 17 and 22 to 28, when the connector 100 is turned about the mating axis portions 420 along the circumference direction, the state of the connector 100 is changed from the unconnected state shown in FIG. 17 to the first intermediate state shown in FIGS. 22 to 28. In detail, referring to FIGS. 21 and 26, when the connector 100 under the unconnected state shown in FIG. 21 is turned clockwise along the circumference direction, the mating guide portions 480 are received into the guide portions 180, respectively. Referring to FIGS. 26 and 27, when the clockwise turn of the connector 100 is continued, the mating guide portions 480 are moved in the guide portions 180, respectively, so that the abutment surface 172 of the temporarily regulated portion 170 is brought into abutment with the abutment surface 456 of the temporarily regulation portion 454. This abutment temporarily regulates a further turn of the connector 100, and the connector 100 is temporarily kept under the first intermediate state.

As shown in FIG. 24, when the connector 100 takes the first intermediate state, the power terminal 200 is connected to the two mating power terminals 500 so that the mating power terminals 500 are connected with each other. In detail, each of the blades 210 of the power terminal 200 is located in the corresponding mating power terminal 500, pressed inward in the Y-direction by the spring portions 520 of the mating power terminal 500 and brought into contact with the contact points 510 of the mating power terminal 500 in the Y-direction (axial direction). Meanwhile, as shown in FIG. 25, the detection terminal 300 is unconnected to the mating detection terminals 700 so that the two signal cables 820 are unconnected with each other. Therefore, the power system (not shown) can make control so that electric current does not flow through the power cables 810.

Figure 28:
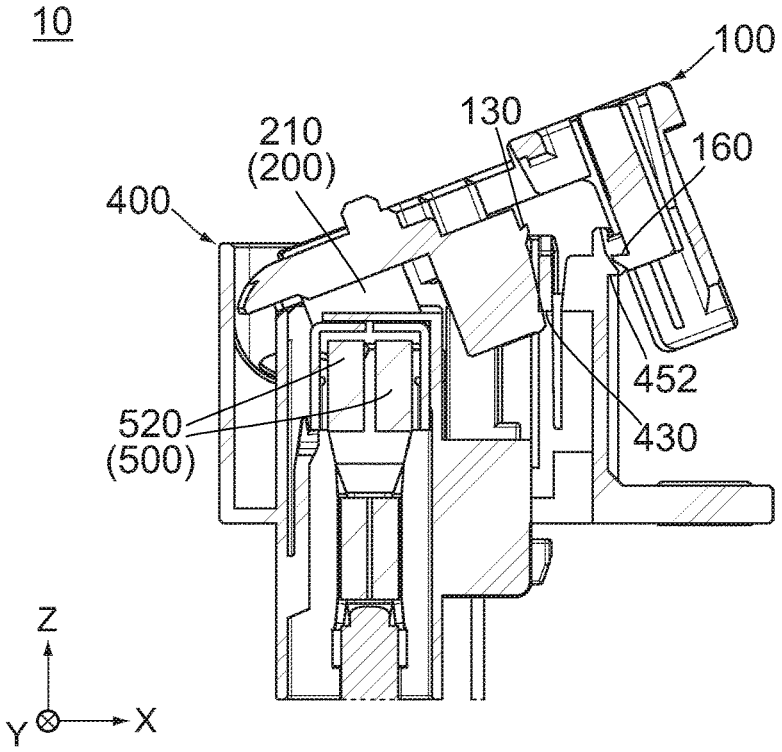
FIG. 28 is a cross-sectional view showing the connector device of FIG. 23, taken along line XXVIII-XXVIII.

As can be seen from FIGS. 24, 27 and 28, in a connection process of the power terminal 200 to the mating power terminals 500, the contact end 212 of each of the blades 210 is first inserted between the contact point 510 and the spring portion 520 that are located at the negative X-side of the corresponding mating power terminal 500, and subsequently, the contact end 214 of each of the blades 210 is inserted between the contact point 510 and the spring portion 520 that are located at the positive X-side of the corresponding mating power terminal 500. This step-by-step connection reduces spring force applied to the power terminal 200 so that the power terminal 200 can be connected to the mating power terminals 500 with a relatively small insertion force. Moreover, each of the contact ends 212 and 214 extends roughly along the X-direction when starting to be brought into contact with the corresponding spring portion 520, and the whole of each of the contact ends 212 and 214 in the X-direction is brought into contact with the corresponding spring portion 520. This mechanism facilitates to prevent the spring portions 520 from being twisted and to smoothly connect the power terminal 200 to the mating power terminals 500.

As can be seen from FIG. 27, when the second operation portion 154 of the connector 100 under the first intermediate state is operated to be moved outward in the radial direction, or in the positive X-direction and the positive Z-direction in FIG. 27, the second spring portions 152 are resiliently deformed, and the temporarily regulated portion 170 is moved outward in the radial direction. As a result, the regulation of the temporarily regulated portion 170 by the temporarily regulation portion 454 is released, and the connector 100 can be turned toward the closed position shown in FIG. 29.

Figure 33:
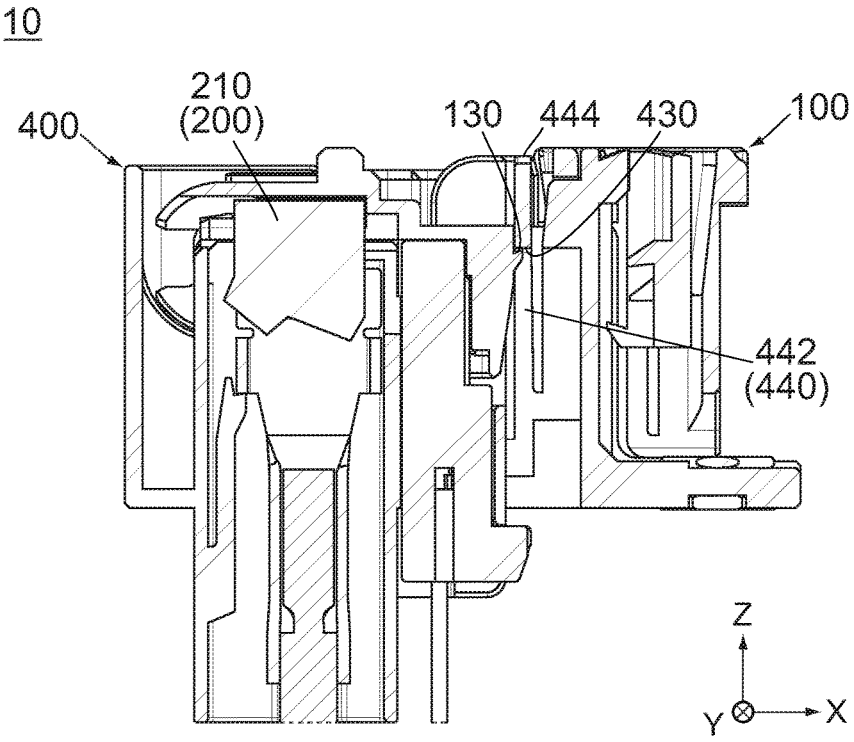
FIG. 33 is a cross-sectional view showing the connector device of FIG. 30, taken along line XXXIII-XXXIII.
Figure 34:
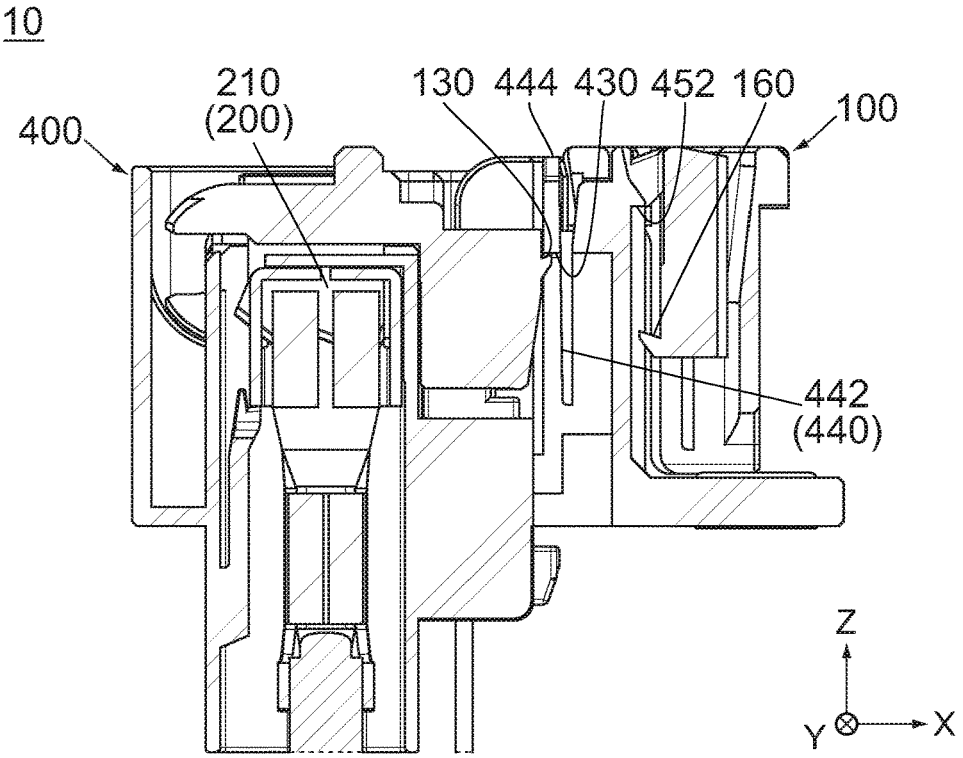
FIG. 34 is a cross-sectional view showing the connector device of FIG. 30, taken along line XXXIV-XXXIV.

Referring to FIGS. 22 and 29 to 35, when the thus-released connector 100 is turned clockwise along the circumference direction, the state of the connector 100 is changed from the first intermediate state shown in FIG. 22 to the connected state shown in FIGS. 29 to 34 via the second intermediate state (intermediate state) shown in FIG. 35. Referring to FIGS. 33 and 34, when the connector 100 takes the connected state, the connector 100 is located at the closed position and cannot be turned clockwise beyond the closed position. Meanwhile, the first regulation portion 430 is located above the first regulated portion 130 to regulate an upward movement of the first regulated portion 130. This regulation of the first regulated portion 130 by the first regulation portion 430 stops a counterclockwise turn that returns the connector 100 back to the second intermediate state (intermediate state). Thus, the connector 100 is kept under the connected state.

Figure 31:
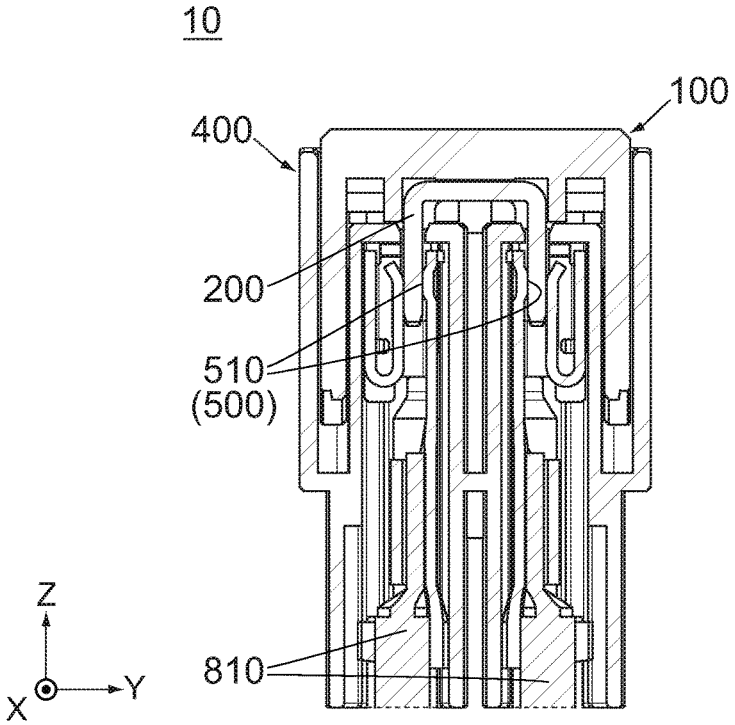
FIG. 31 is a cross-sectional view showing the connector device of FIG. 30, taken along line XXXI-XXXI.

As shown in FIG. 31, when the connector 100 takes the connected state, the power terminal 200 is connected to the two mating power terminals 500. Meanwhile, as shown in FIG. 32, the detection terminal 300 is connected to the two mating detection terminals 700 so that the mating detection terminals 700 are connected with each other. In other words, the connector 100 is completely mated with the mating connector 400, and the power system (not shown) can make control so that electric current flows through the power cables 810. Thus, when the connector 100 is completely mated with the mating connector 400, the connector device 10 connects the power system and the motor (not shown) with each other so that the power system supplies electric current to the motor.

As can be seen from FIGS. 33 and 34, when the first operation portion 444 is operated to be moved outward in the radial direction, or in the positive X-direction in FIGS. 33 and 34, under the connected state of the connector 100, the first spring portions 442 are resiliently deformed, and the first regulation portion 430 is moved outward in the radial direction. As a result, the regulation of the first regulated portion 130 by the first regulation portion 430 is released, and the connector 100 can be turned counterclockwise.

Figure 37:
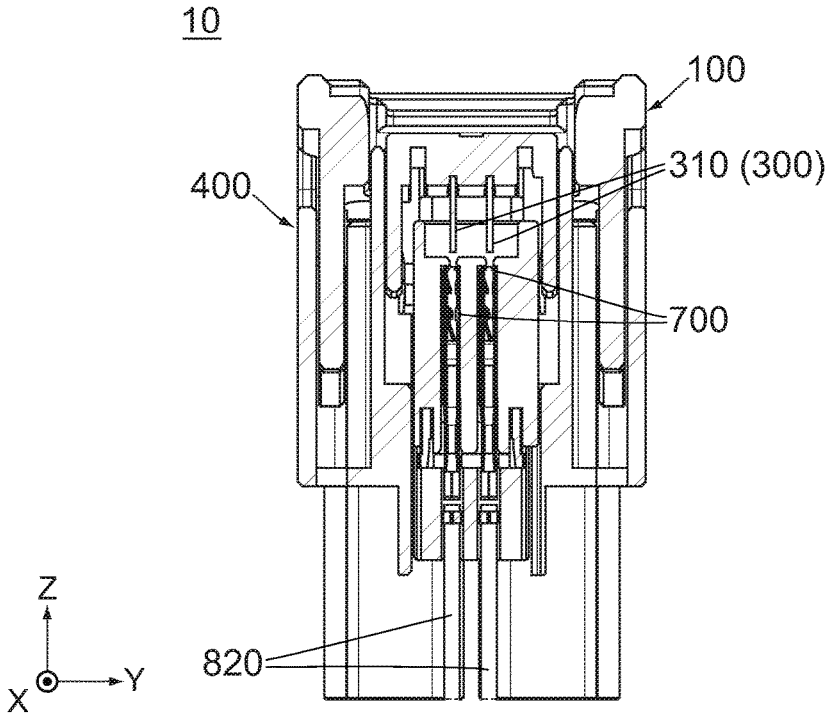
FIG. 37 is a cross-sectional view showing the connector device of FIG. 36, taken along line XXXVII-XXXVII.
Figure 38:
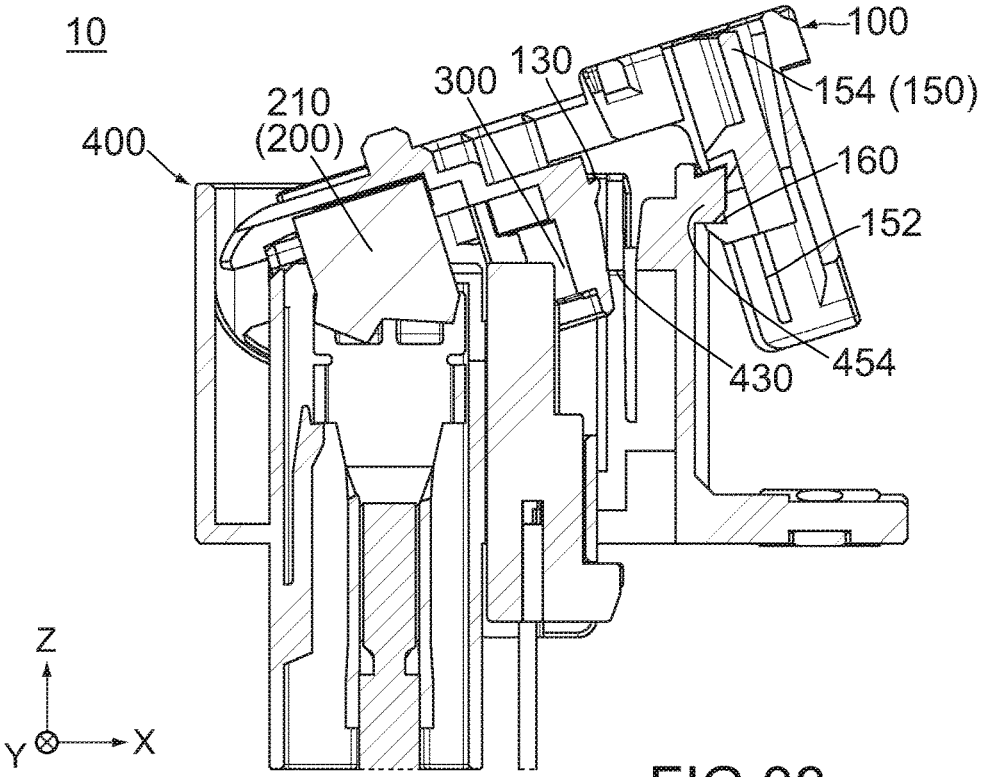
FIG. 38 is a cross-sectional view showing the connector device of FIG. 36, taken along line XXXVIII-XXXVIII.
Figure 39:
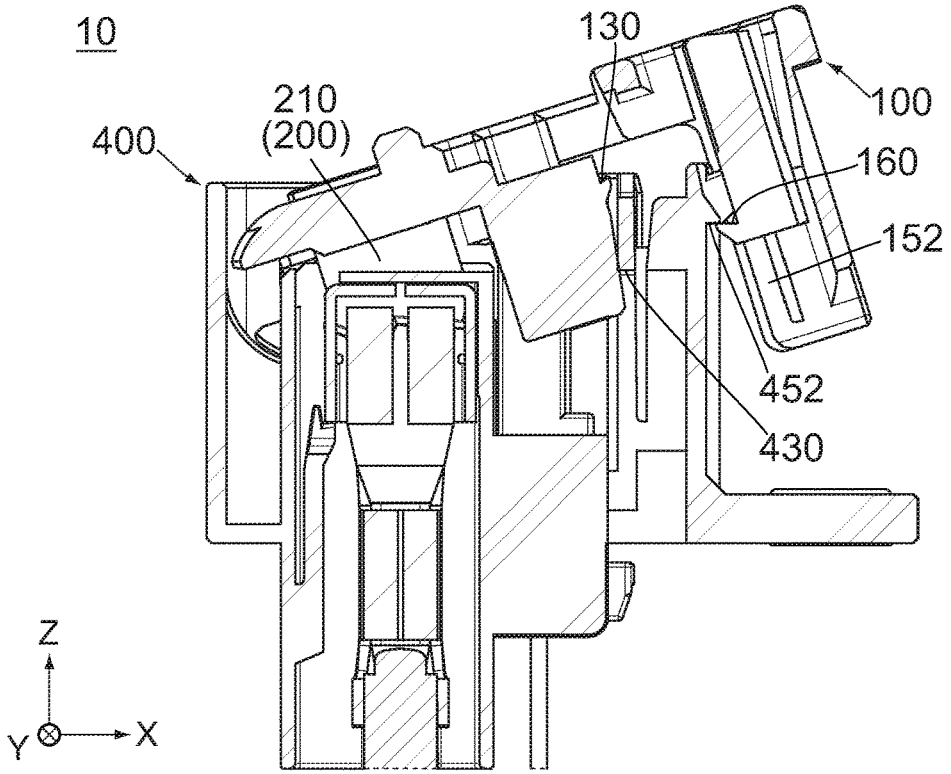
FIG. 39 is a cross-sectional view showing the connector device of FIG. 36, taken along line XXXIX-XXXIX.

Referring to FIGS. 29 and 35 to 39, when the connector 100 is turned counterclockwise along the circumference direction, the state of the connector 100 is changed from the connected state shown in FIG. 29 to the second intermediate state (intermediate state) shown in FIGS. 35 to 39. Referring to FIG. 38, when the connector 100 is thus-turned, the second regulated portions 160 are brought into abutment with the second regulation portions 452. This abutment temporarily regulates a counterclockwise turn of the connector 100 beyond the second intermediate state (intermediate state), and the connector 100 is temporarily kept under the second intermediate state (intermediate state).

As can be seen from FIG. 38, when the state of the connector 100 is changed from the connected state to the second intermediate state (intermediate state), the power terminal 200 is kept to be connected to the mating power terminals 500. In contrast, as shown in FIG. 37, when the state of the connector 100 is thus changed, the detection terminal 300 is disconnected from the mating detection terminals 700. As a result, the power system (not shown) makes control so that the electric current supplied to the power cables 810 is stopped.

As can be seen from FIG. 38, when the second operation portion 154 of the connector 100 under the second intermediate state (intermediate state) is operated to be moved outward in the radial direction, or in the positive X-direction and the positive Z-direction in FIG. 38, the second spring portions 152 are resiliently deformed, and the second regulated portions 160 are moved outward in the radial direction. As a result, the regulation of the second regulated portions 160 by the second regulation portions 452 is released, and the connector 100 can be turned counterclockwise to the unconnected state shown in FIG. 17 via the first intermediate state shown in FIG. 22. This turn disconnects the power terminal 200 from the mating power terminals 500.

Referring to FIG. 17, when the connector 100 is under the unconnected state, the connector 100 is movable upward and is removable from the mating connector 400 by this upward movement.

As described above, the connector 100 according to the present embodiment changes its state between the unconnected state and the connected state via the first intermediate state and the second intermediate state. Referring to FIGS. 24, 25, 37 and 38, in each of the first intermediate state and the second intermediate state, the power terminal 200 is connected to the mating power terminals 500, but the detection terminal 300 is unconnected to the mating detection terminals 700. Moreover, the connector 100 under the first intermediate state and the connector 100 under the second intermediate state are only slightly apart from each other in the circumference direction. Although the second intermediate state is defined as "intermediate state" in the present embodiment, the first intermediate state may be defined as "intermediate state". Moreover, the connector 100 can be configured to change its state between the unconnected state and the connected state via only one intermediate state.

Figure 40:
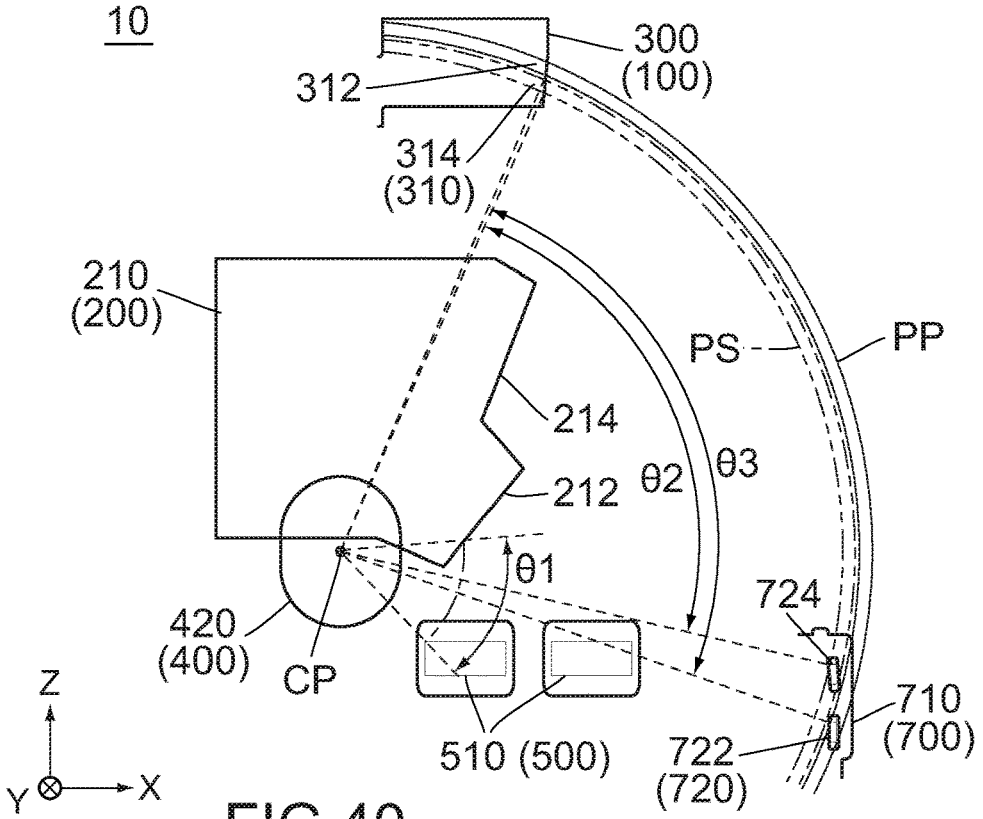
FIG. 40 is a view showing a positional relation among projected images onto a perpendicular plane of a shaft, the power terminal, the mating power terminal, the detection terminal and the mating detection terminal of the connector device of FIG. 17, wherein the perpendicular plane is perpendicular to a direction in which the shaft extends.
Figure 41:
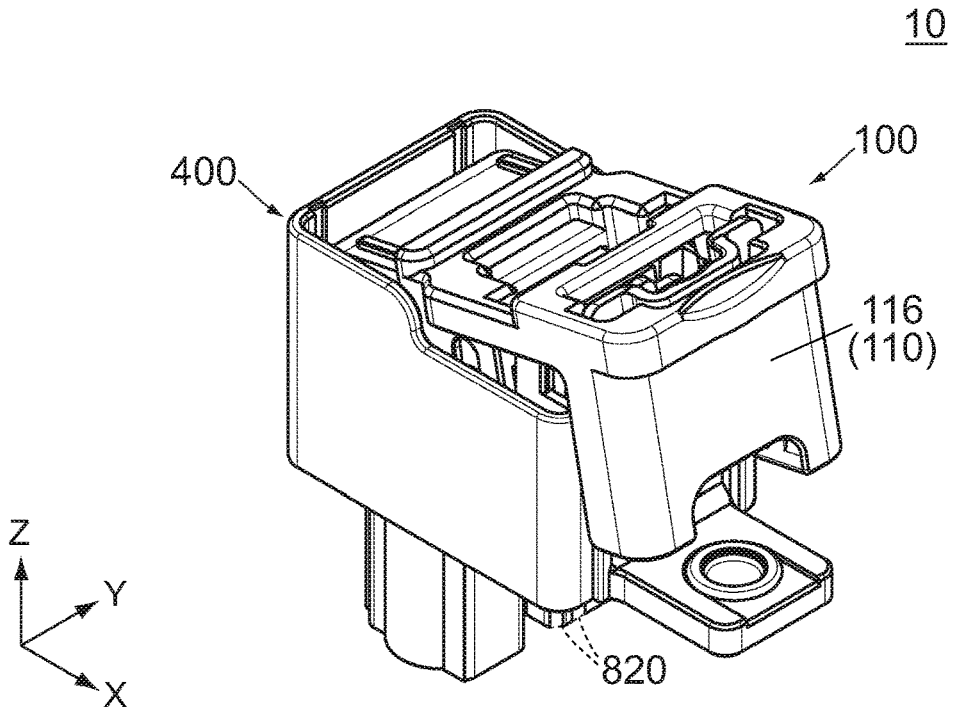
FIG. 41 is another perspective view showing the connector device of FIG. 1, wherein the connector is in a connection process in which the state of the connector is changed from the first intermediate state to the connected state, or in a disconnection process in which the state of the connector is changed from the connected state toward the second intermediate state, and the lower parts of the power cables and the lower parts of the signal cables are not illustrated.
Figure 42:
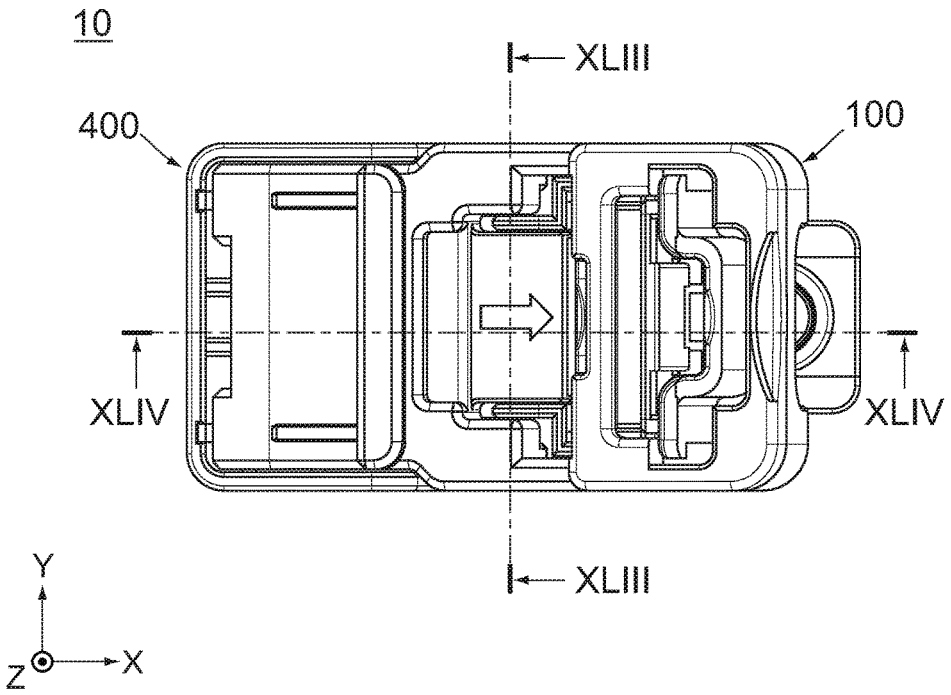
FIG. 42 is a plan view showing the connector device of FIG. 41.

Referring to FIG. 40, when the shaft 420, the power terminal 200, the mating power terminal 500, the detection terminal 300 and the mating detection terminal 700 of the connector device 10 under the unconnected state are projected onto the perpendicular plane (XZ-plane) perpendicular to the Y-direction (axial direction) in which the shaft 420 extends, the projected images of these members are located in a polar coordinate system around a center point CP of the shaft 420. In this polar coordinate system, the power terminal 200 and the mating power terminal 500 are apart from each other by an angle θ1, and the detection terminal 300 and the mating detection terminal 700 are apart from each other by an angle θ2. In detail, the contact end 212 of the power terminal 200 is apart from the negative X-side contact point 510 of the two contact points 510 of the mating power terminal 500 by the angle θ1. Moreover, an edge of the sub-contact 314 of the detection terminal 300 is apart from another edge of the mating sub-contact 724 of the mating detection terminal 700 by the angle θ2.

As shown in FIG. 40, the angle θ1 is smaller than the angle θ2. Because of this arrangement, the detection terminal 300 is connected to the mating detection terminals 700 after the power terminal 200 is connected to the mating power terminals 500. Moreover, the power terminal 200 is disconnected from the mating power terminals 500 after the detection terminal 300 is disconnected from the mating detection terminals 700. Therefore, no arc discharge is generated between the power terminal 200 and the mating power terminals 500, while arc discharge might be generated between the detection terminal 300 and the mating detection terminals 700.

Hereafter, explanation is made in detail about functions of the detection terminal 300 and the mating detection terminal 700.

Referring to FIGS. 29, 35 and 41 to 44, the state of the connector 100 is changed from the second intermediate state (intermediate state) shown in FIG. 35 to the connected state shown in FIG. 29 via a state shown in FIGS. 41 to 44.

Figure 45:
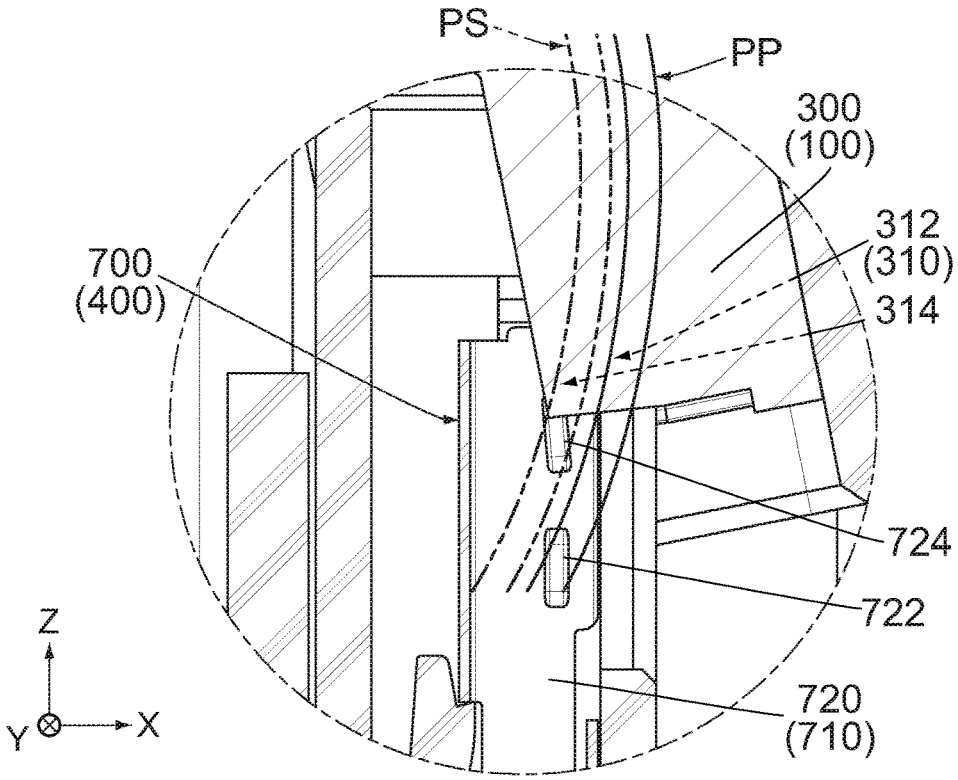
FIG. 45 is an enlarged, cross-sectional view showing a connection surface of the mating detection terminal and therearound (part enclosed by chain dotted line A) of FIG. 44.

Referring to FIGS. 40 and 45, during a connection process, in which the state of the connector 100 is changed from the second intermediate state (intermediate state) to the connected state, the main contact 312 is moved along a main path PP to be brought into contact with the mating main contact 722, and the sub-contact 314 is moved along a sub-path PS to be brought into contact with the mating sub-contact 724. Each of the main path PP and the sub-path PS extends along a first direction (circumference direction). The main path PP and the sub-path PS are apart from each other in a second direction (radial direction) perpendicular to the first direction.

Referring to FIG. 40, when the connector device 10 takes the unconnected state, an edge of the main contact 312 of the detection terminal 300 is apart from another edge of the mating main contact 722 of the mating detection terminal 700 by an angle θ3. The angle θ3 is larger than the angle θ2. Therefore, in the connection process, the sub-contact 314 is brought into contact with the mating sub-contact 724 before the main contact 312 is brought into contact with the mating main contact 722.

Figure 43:
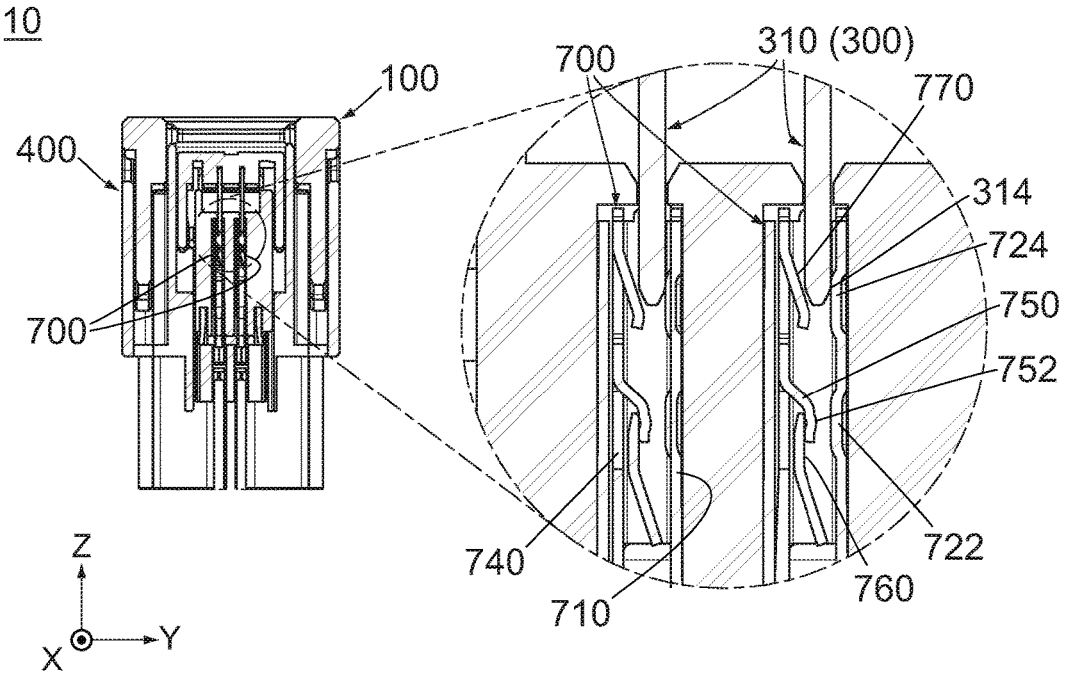
FIG. 43 is a cross-sectional view showing the connector device of FIG. 42, taken along line XLIII-XLIII, wherein contact parts between the detection terminals and the mating detection terminals and therearound (parts enclosed by chain dotted line) are illustrated to be enlarged.
Figure 44:
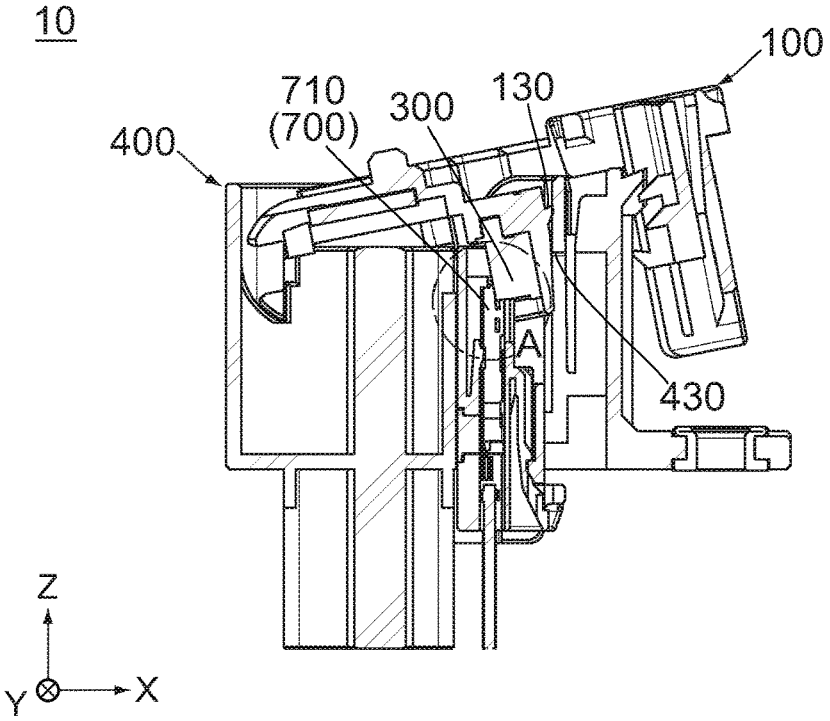
FIG. 44 is a cross-sectional view showing the connector device of FIG. 42, taken along line XLIV-XLIV.

Referring to FIG. 43, in the connection process, each of the connection portions 310 of the detection terminal 300 is inserted between the connection plate 710 and the spring plate 740 of the corresponding mating detection terminal 700. In detail, in a first phase of the connection process, the sub-spring 770 presses the sub-contact 314 against the mating sub-contact 724 so that the sub-contact 314 is securely brought into contact with the mating sub-contact 724. As described above, the mating connector 400 of the present embodiment comprises a pressing member consisting of the sub-spring 770 that presses the sub-contact 314 against the mating sub-contact 724.

Referring to FIG. 32, in a second phase of the connection process, the main spring 750 presses the main contact 312 against the mating main contact 722 so that with the main contact 312 is securely brought into contact with the mating main contact 722. Since the main spring 750 is reinforced by the auxiliary spring 760, the main contact 312 is securely pressed against the mating main contact 722. As described above, the mating connector 400 of the present embodiment comprises another pressing member consisting of the main spring 750 and the auxiliary spring 760 that presses the main contact 312 against the mating main contact 722.

According to the present embodiment, in the connection process of the detection terminal 300 to the mating detection terminals 700, each of the sub-contacts 314 is first inserted between the mating sub-contact 724 and the sub-spring 770, and subsequently, each of the main contacts 312 is inserted between the mating main contact 722 and the main spring 750. This step-by-step connection reduces spring force applied to the detection terminal 300 so that the detection terminal 300 can be connected to the mating detection terminal 700 with a relatively small insertion force.

Figure 46:
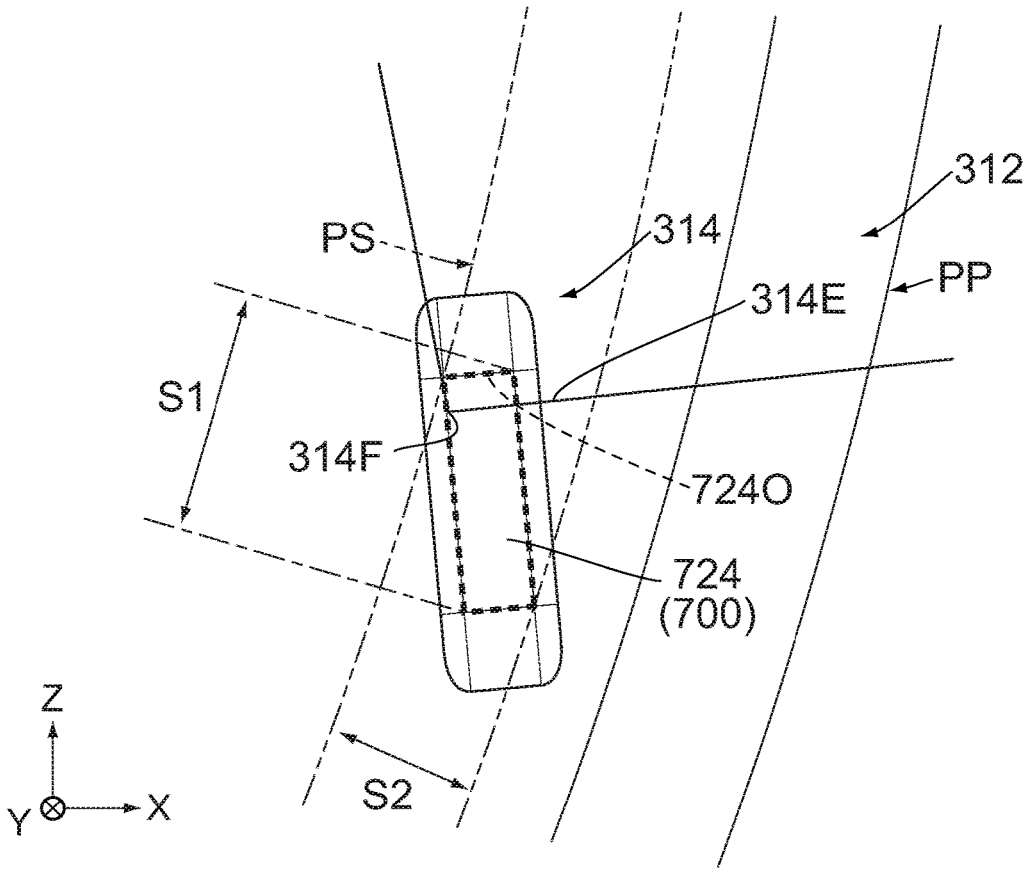
FIG. 46 is a view showing a positional relation between a sub-contact of the detection terminal and a mating sub-contact of the mating detection terminal of FIG. 45.
Figure 47A:
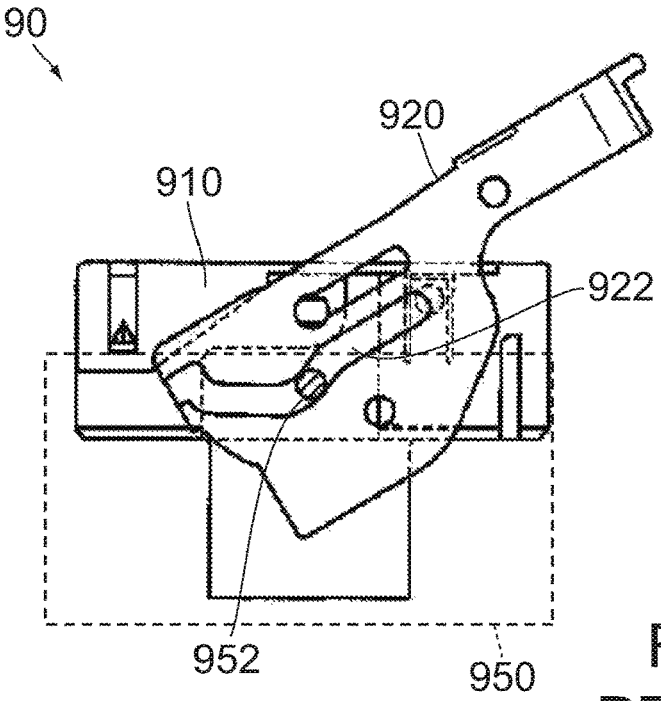
FIG.47A PRIOR ART
FIG. 47A to 47C are side views each showing a power circuit breaker with lever-for-mating-operation (connector device) of Patent Document 1, wherein a connector thereof is illustrated in continuous line, and a mating connector thereof is illustrated in dashed line.
Figure 47B:
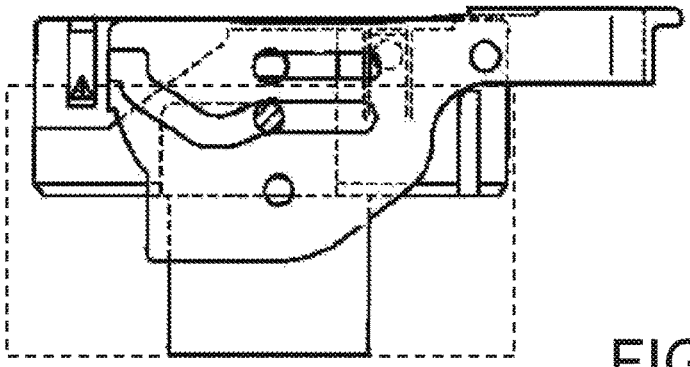
FIG.47B PRIOR ART
Figure 47C:
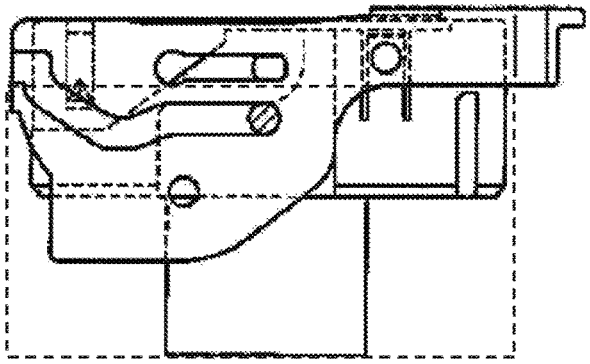
FIG.47C PRIOR ART

As can be seen from FIGS. 32, 45 and 46, when the sub-contact 314 starts to be brought into contact with the sub-spring 770, a lower edge of the sub-contact 314, namely a contact edge 314E, extends roughly in parallel to an upper edge of the mating sub-contact 724, and the whole of the contact edge 314E is brought into contact with the sub-spring 770. Similarly, when the main contact 312 starts to be brought into contact with the main spring 750, a lower edge of the main contact 312 extends roughly in parallel to an upper edge of the mating main contact 722, and the whole of the lower edge in the X-direction is brought into contact with the main spring 750. This mechanism facilitates to prevent the sub-spring 770 and the main spring 750 from being twisted and to smoothly connect the detection terminal 300 to the mating detection terminals 700.

As shown in FIG. 32, when the connector 100 of the present embodiment takes the connected state, the two connection portions 310 of the detection terminal 300 are connected to the two mating detection terminals 700, respectively. In each of the connection portions 310, the main contact 312 is in contact with the mating main contact 722 in the Y-direction (axial direction) and the sub-contact 314 is in contact with the mating sub-contact 724 in the Y-direction. However, the present invention is not limited thereto. For example, the sub-contact 314 may be temporarily apart from the mating detection terminal 700 under the connected state, provided that the main contact 312 is in contact with the mating main contact 722 under the connected state. In other words, when the connector 100 takes the connected state, the detection terminal 300 may be connected to the mating detection terminal 700 at least at the main contact 312 which is in contact with the mating main contact 722.

Referring to FIGS. 29, 35 and 41 to 44, the state of the connector 100 is changed from the connected state shown in FIG. 29 to the second intermediate state (intermediate state) shown in FIG. 35 via the state shown in FIGS. 41 to 44. Referring to FIG. 45, during a disconnection process in which the state of the connector 100 is changed from the connected state to the second intermediate state (intermediate state), the main contact 312 is moved along the main path PP to be disconnected from the mating main contact 722, and the sub-contact 314 is moved along the sub-path PS. In the disconnection process, the sub-contact 314 is in contact with the mating sub-contact 724 at a time of disconnection of the main contact 312 from the mating main contact 722 and is disconnected from the mating sub-contact 724 subsequent to the disconnection of the main contact 312 from the mating main contact 722. In the connection process, the sub-contact 314 is brought into contact with the mating sub-contact 724 prior to the contact of the main contact 312 with the mating main contact 722.

As described above, at a certain moment when the main contact 312 is disconnected from the mating main contact 722, the sub-contact 314 and the mating sub-contact 724 are in contact with each other. Therefore, no arc discharge is generated between the main contact 312 and the mating main contact 722. This fact is also true in the connection process of the connector 100. In detail, at a certain moment when the main contact 312 is brought into contact with the mating main contact 722, the sub-contact 314 and the mating sub-contact 724 are already in contact with each other. Therefore, no arc discharge is generated between the main contact 312 and the mating main contact 722.

Moreover, the main path PP and the sub-path PS are apart from each other. Even if arc discharge is generated between the sub-contact 314 and the mating sub-contact 724 at a time when the sub-contact 314 is brought into contact with or disconnected from the mating sub-contact 724, the main contact 312 and the mating main contact 722 are hardly affected. Thus, the detection terminal 300 and the mating detection terminals 700 can be prevented from being functionally damaged even after a larger number of insertion and removal of the connector 100 into and from the mating connector 400, so that poor electrical connection between the connector 100 and the mating connector 400 can be prevented.

Referring to FIG. 46, the sub-contact 314 includes a predetermined part that is finally disconnected from the mating sub-contact 724 in the disconnection process, and the mating sub-contact 724 includes a mating predetermined part that is finally disconnected from the sub-contact 314 in the disconnection process. Arc discharge is generated between the predetermined part and the mating predetermined part. Each of the predetermined part and the mating predetermined part is burnt because of arc discharge and increases in its electrical resistivity so that its electrical connection ability is almost lost. In other words, each of the predetermined part and the mating predetermined part is damaged and no longer works as a part for arc discharge. As a result, in every disconnection process, the sub-contact 314 changes a position of a part thereof that works as the predetermined part, and the mating sub-contact 724 changes a position of a part thereof that works as the mating predetermined part.

In the present embodiment, the mating sub-contact 724 is the end surface of the projection, and the damaged part of the mating sub-contact 724 due to arc discharge grows clockwise along the sub-path PS from an upper edge of the outer edge 724O of the mating sub-contact 724. Moreover, the mating sub-contact 724 of the present embodiment has a size S1 in the first direction (circumference direction) along which the sub-path PS extends, and the size S1 is larger than another size S2 of the mating sub-contact 724 in the second direction (radial direction). According to this structure, the mating sub-contact 724 can work as a part for arc discharge for a relatively long time while the main path PP and the sub-path PS can be apart from each other only by a necessary distance.

Referring to FIG. 45, the aforementioned structure of the mating sub-contact 724 may be applied not to the mating sub-contact 724 but to the sub-contact 314. More specifically, the mating sub-contact 724 may be a part of the connection surface 720 while the sub-contact 314 may be an end surface of a projection that projects from the connection portion 310 in the positive Y-direction. In this structure, a size of the sub-contact 314 in the first direction (circumference direction), along which the sub-path PS extends, may be larger than another size thereof in the second direction (radial direction). Thus, at least one of the sub-contact 314 and the mating sub-contact 724 may have a size in the first direction that is larger than another size in the second direction perpendicular to the first direction.

Referring to FIG. 46, in the present embodiment, the sub-contact 314 is a part of the positive Y-side surface of the connection portion 310, and the mating sub-contact 724 projects in a direction (negative Y-direction) perpendicular to both the first direction (circumference direction) and the second direction (radial direction), and extends long along a longitudinal direction intersecting with the first direction. According to this structure, the damaged part of the sub-contact 314 due to arc discharge grows outward in the radial direction along the contact edge 314E from a starting point 314F on the contact edge 314E of the sub-contact 314. Therefore, arc discharge in the disconnection process can be controlled to be generated at relatively constant timing.

Referring to FIG. 45, the structure of the sub-contact 314 and the structure of the mating sub-contact 724 described above may be exchanged with each other. More specifically, the mating sub-contact 724 may be a part of the connection surface 720. In this case, the sub-contact 314 may project from the positive Y-side surface of the connection portion 310 in a direction (positive Y-direction) perpendicular to both the first direction (circumference direction) and the second direction (radial direction) and may extend long along a longitudinal direction intersecting with the first direction. Thus, at least one of the sub-contact 314 and the mating sub-contact 724 may project in a direction perpendicular to both the first direction and the second direction and may extend long along the longitudinal direction intersecting with the first direction.

Referring to FIG. 43, in the disconnection process, the sub-contact 314 is pressed against the mating sub-contact 724 by the sub-spring 770 until a short time before separated from the mating sub-contact 724 in the circumference direction. Referring to FIGS. 43 and 46, the thus-pressed sub-contact 314 is not separated from the mating sub-contact 724 in the negative Y-direction until separation of the contact edge 314E from the mating sub-contact 724 in the circumference direction even after the mating sub-contact 724 is separated from the sub-spring 770. Thus, according to the present embodiment, arc discharge can be controlled to be generated at the contact edge 314E of the sub-contact 314.

Referring to FIG. 45, in the present embodiment, the connection surface 720, on which the mating main contact 722 and the mating sub-contact 724 are provided, extends in a plane in parallel to both the main path PP and the sub-path PS. More specifically, the mating main contact 722 and the mating sub-contact 724 are provided on a common side, or the negative Y-side, of the connection plate 710. According to the present embodiment, the mating main contact 722 and the mating sub-contact 724 can be made contact with the common connection portion 310, so that the structure of the detection terminal 300 can be made relatively simple.

In a case where the mating main contact 722 and the mating sub-contact 724 are provided on a common surface, the main contact 312 and the mating main contact 722 might be affected by arc discharge generated between the sub-contact 314 and the mating sub-contact 724. However, according to the present embodiment, the mating sub-contact 724 is located above the mating main contact 722 in the XZ-plane, and an upper end of the mating main contact 722 is shifted forward from an upper end of the mating sub-contact 724. This structure facilitates to reduce influence of arc discharge on the mating main contact 722. In addition, in the XZ-plane, the mating sub-contact 724 extends in a direction intersecting with another direction in which the mating main contact 722 extends. This structure facilitates to make the distance between the main path PP and the sub-path PS longer so that influence of arc discharge on the main contact 312 can be further reduced.

The embodiment of the present invention is specifically explained above. However, the present invention is not limited thereto but can be variously modified as described below.

Referring to FIG. 45, the structure and the arrangement of the detection terminal 300 and the mating detection terminal 700 can be variously modified, provided that the distance between the main path PP and the sub-path PS can be made sufficiently long.

Referring to FIGS. 15 and 16, the connector device 10 has three regulation mechanisms, namely the regulation of the first regulated portion 130 by the first regulation portion 430, the regulation of the second regulated portions 160 by the second regulation portions 452 and the regulation of the temporarily regulated portion 170 by the temporarily regulation portion 454. However, one or more of the aforementioned three regulation mechanisms can be omitted. For example, the state of the connector 100 may be changed between the unconnected state and the connected state without temporarily maintained at the first intermediate state and the second intermediate state.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

What is claimed is:

1. A connector device comprising a connector and a mating connector which are mateable with each other, wherein:

the connector comprises a housing, a power terminal and a detection terminal;

the power terminal and the detection terminal are held by the housing;

the detection terminal has a main contact and a sub-contact for arc discharge;

the mating connector comprises a mating housing, a mating power terminal and a mating detection terminal;

the mating power terminal and the mating detection terminal are held by the mating housing;

the mating detection terminal has a mating main contact and a mating sub-contact for arc discharge;

a state of the connector relative to the mating connector is changeable between an unconnected state and an intermediate state and is changeable between the intermediate state and a connected state;

when the connector takes the unconnected state, the power terminal is unconnected to the mating power terminal, and the detection terminal is unconnected to the mating detection terminal;

when the connector takes the intermediate state, the power terminal is connected to the mating power terminal, but the detection terminal is unconnected to the mating detection terminal;

when the connector takes the connected state, the power terminal is connected to the mating power terminal, and the detection terminal is connected to the mating detection terminal at least at the main contact which is in contact with the mating main contact;

during a disconnection process in which the state of the connector is changed from the connected state to the intermediate state, the main contact is moved along a main path to be disconnected from the mating main contact, and the sub-contact is moved along a sub-path;

in the disconnection process, the sub-contact is in contact with the mating sub-contact at a time of disconnection of the main contact from the mating main contact and is disconnected from the mating sub-contact subsequent to the disconnection of the main contact from the mating main contact; and the main path and the sub-path are apart from each other.

2. The connector device as recited in claim 1, wherein:

the main path extends along a first direction; and at least one of the sub-contact and the mating sub-contact has a size in the first direction that is larger than another size thereof in a second direction perpendicular to the first direction.

3. The connector device as recited in claim 2, wherein at least one of the sub-contact and the mating sub-contact projects in a direction perpendicular to both the first direction and the second direction and extends long along a longitudinal direction intersecting with the first direction.

4. The connector device as recited in claim 1, wherein:

the mating detection terminal has a connection surface;

the connection surface extends in a plane in parallel to both the main path and the sub-path; and each of the mating main contact and the mating sub-contact is provided on the connection surface.

5. The connector device as recited in claim 1, wherein:

the housing is formed with an axis portion;

the mating housing is formed with a mating axis portion;

one of the axis portion and the mating axis portion is a shaft, and a remaining one of the axis portion and the mating axis portion is a bearing;

the shaft extends in an axial direction;

when the axis portion and the mating axis portion are combined with each other, the connector is turnable on the shaft relative to the mating connector; and a turn of the connector relative to the mating connector changes the state of the connector among the unconnected state, the intermediate state and the connected state.

6. The connector device as recited in claim 5, wherein, in a plane perpendicular to the axial direction, the mating sub-contact extends in a direction intersecting with another direction in which the mating main contact extends.

7. The connector device as recited in claim 5, wherein, the main contact is in contact with the mating main contact in the axial direction.

8. The connector device as recited in claim 1, wherein, the mating connector comprises a pressing member which presses the sub-contact against the mating sub-contact.

* * * * *